US007457572B2

(12) United States Patent
Onuma et al.

(10) Patent No.: US 7,457,572 B2
(45) Date of Patent: Nov. 25, 2008

(54) IMAGE FORMING METHOD AND PROCESS CARTRIDGE USING SPECIFIC TONER REGULATING BLADE AND TONER

(75) Inventors: Tsutomu Onuma, Yokohama (JP); Yoshihiro Ogawa, Numazu (JP); Yusuke Hasegawa, Suntoh-gun (JP); Koji Nishikawa, Suntoh-gun (JP); Tomohisa Sano, Suntoh-gun (JP); Junko Nishiyama, Suntoh-gun (JP); Miho Okazaki, Susono (JP); Takashige Kasuya, Suntoh-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 309 days.

(21) Appl. No.: 11/472,300

(22) Filed: Jun. 22, 2006

(65) Prior Publication Data

US 2007/0059049 A1 Mar. 15, 2007

(30) Foreign Application Priority Data

Sep. 14, 2005 (JP) ..... 2005-266743

(51) Int. Cl.
*G03G 15/08* (2006.01)

(52) U.S. Cl. ..... 399/284

(58) Field of Classification Search ..... 399/252, 399/274, 284; 430/110.3, 111.4, 120.1
See application file for complete search history.

(56) References Cited

U.S. PATENT DOCUMENTS

| | | | | |
|---|---|---|---|---|
| 5,137,796 | A * | 8/1992 | Takiguchi et al. | 430/110.4 |
| 5,240,803 | A | 8/1993 | Ota | 430/106 |
| 5,262,267 | A * | 11/1993 | Takiguchi et al. | 430/122.51 |
| 5,682,585 | A | 10/1997 | Yamaguchi et al. | |
| 5,729,811 | A * | 3/1998 | Takahata et al. | 399/316 |
| 6,524,762 | B2 * | 2/2003 | Tsutsui et al. | 430/108.8 |
| 6,738,593 | B2 | 5/2004 | Kawamura et al. | |
| 6,879,798 | B2 * | 4/2005 | Aoki | 399/252 |
| 6,909,869 | B2 | 6/2005 | Yamamoto et al. | 399/284 |
| 7,003,249 | B2 | 2/2006 | Hasegawa et al. | |
| 7,016,633 | B2 | 3/2006 | Ishigaki | 399/279 |
| 7,272,348 | B2 * | 9/2007 | Okamoto et al. | 399/269 |
| 2003/0194250 | A1 | 10/2003 | Ishigaki | 399/279 |
| 2004/0029031 | A1 | 2/2004 | Yamazaki et al. | 430/137.14 |
| 2007/0059049 | A1 | 3/2007 | Onuma et al. | |

FOREIGN PATENT DOCUMENTS

| | | |
|---|---|---|
| JP | 3-84558 | 4/1991 |
| JP | 3-229268 | 10/1991 |
| JP | 4-1766 | 1/1992 |
| JP | 4-102862 | 4/1992 |
| JP | 6-186838 | 7/1994 |
| JP | 2986343 | 10/1999 |
| JP | 2000-330376 | 11/2000 |
| JP | 2003-270856 | 9/2003 |
| JP | 2004-4751 | 1/2004 |
| JP | 2004-12542 | 1/2004 |
| JP | 2004-94138 | 3/2004 |
| JP | 2004-117919 | 4/2004 |
| JP | 2004-117996 | 4/2004 |
| JP | 2004-188725 | 7/2004 |

* cited by examiner

*Primary Examiner*—Robert Beatty
(74) *Attorney, Agent, or Firm*—Fitzpatrick, Cella, Harper & Scinto

(57) ABSTRACT

An image forming method and related process cartridge, the method having the steps of controlling the layer thickness of a toner on a toner bearing member by means of a toner regulating blade, and developing with the toner an electrostatic latent image formed on an electrostatic latent image bearing member, the toner regulating blade has, at its part to be kept in touch with the toner bearing member, a specific ten-point average roughness Rz and a specific ratio (area of contact portion/area of non-contact portion) at a specific face pressure, and the toner has a specific average circularity and has a specific aerated bulk density. This image forming method and process cartridge promise superior developing performance in any environment, can keep sleeve negative ghost from occurring and can keep toner melt adhesion to toner regulating blade and toner melt adhesion to toner bearing member from occurring.

7 Claims, 2 Drawing Sheets

IMAGE FORMING METHOD AND PROCESS CARTRIDGE USING SPECIFIC TONER REGULATING BLADE AND TONER

BACKGROUND OF THE INVENTION

1. Field of the Invention

This invention relates to an image forming method for rendering electrostatic latent images visible by electrophotography. It also relates to a process cartridge used in the image forming method.

2. Related Background Art

As a commonly available image forming method for electrophotography, a method is known in which fixed images are obtained by, e.g., forming an electrostatic latent image on an electrostatic latent image bearing member by utilizing a photoconductive material and by various means, subsequently developing the latent image into a toner image by means of a developing assembly to make the latent image visible, and then transferring the toner image onto a transfer material such as paper as occasion calls, followed by fixing by the action of heat, pressure, heat-and-pressure, or solvent vapor.

As the developing assembly in such electrophotography, an assembly is commonly known which is so set up that a toner regulating blade made of rubber or metal, serving as a toner layer thickness control member for controlling a toner coat level, is kept in contact with the surface of a developing sleeve serving as a toner bearing member.

A toner is provided with positive or negative electric charges by the friction between such a toner regulating blade and the toner and/or the friction between the toner bearing member and the toner. Further, through the toner bearing member, which has thinly been coated on its surface with the toner by the aid of the toner regulating blade, the toner is allowed to fly and adhere to the electrostatic latent image formed on the surface of the electrostatic latent image bearing member, standing opposite to the toner bearing member, to perform development. Such a technique is commonly used in practice.

As a technical trend of image forming apparatus in recent years, it is sought to achieve further higher speed and higher reliability over a long period of time in addition to a high degree of minuteness of images, high grade images and high image quality. In order to accomplish a high-resolution and high-minuteness developing assembly system, toners having a high developing performance are being put forward to, e.g., make them have smaller particle diameter and have sharper particle size distribution.

Where a toner having such a high developing performance is used in a conventional developing assembly, the toner has tended to cause charge-up because of differences in its chargeability, powder characteristics and so forth, or to be unable to be thin-layer coated on the toner bearing member to come lacking in minuteness of images.

Meanwhile, a variety of improvements of the toner regulating blade, the toner bearing member and so forth have been attempted.

For example, Japanese Patent Application Laid-open No. 2004-4751 discloses a proposal of a developing assembly in which the surface of a developer carrying member has specific hardness and deformation degree and a developer level control blade has a surface ten-point average roughness (Rz) of from 0.3 to 20 μm on its side to be kept in contact with the developer carrying member. In this patent document, examples are disclosed in which a non-magnetic toner is evaluated by using this developing assembly, and it is demonstrated that effects on solid-image density and against unevenness, lines and so forth are brought out in every environment. Meanwhile, sufficient studies have not been made on the stability in long-term running, and, especially when a one-component magnetic toner is used, there has been a tendency of showing an insufficient running stability.

Japanese Patent Application Laid-open No. 2004-12542 also discloses a developer control member which is so set that the surface roughness of the developer control member is more than 2.0 μm as ten-point average roughness Rz and the maximum height Rmax in unevenness is smaller than the average particle diameter of the developer. As disclosed in the Examples in this patent document, in use in combination of a metallic blade and a non-magnetic toner, an effect is brought out against a phenomenon of roller set. However, where, e.g., a urethane rubber blade or a silicone rubber blade other than the metallic blade is used, there has still been room for improvements regarding running stability of developing performance and environmental stability.

Japanese Patent Application Laid-open No. 2000-330376 further discloses a proposal of a toner regulating blade in which the surface roughness of an elastic blade member is specified on its surface that is to come into contract with and rub a developing roller. This patent document discloses that the toner regulating blade of such invention is effective against thick line images and on charging stability when a one-component magnetic toner having an average particle diameter of 8 μm is used in the Examples. However, a sufficient reference is not made to developer properties, and there has still been room for improvements regarding running stability and environmental stability in an instance in which a toner having a high developing performance is used.

Besides these, Japanese Patent Applications Laid-open No. H06-186838 and No. 2004-117996, Japanese Patent No. 2986343, and Japanese Patent Applications Laid-open No. 2004-94138 and No. 2004-117919 also each disclose invention in which the surface roughness of a toner regulating blade is specified.

In all of these patent documents, the surface roughness is specified in the vertical direction, but no argument is made on the surface roughness in the horizontal direction, such as unevenness hill-to-hill intervals or hill density.

Where any of the toner regulating blades as described above are used in a high-speed developing system having an especially high process speed and making use of a process cartridge having a large volume, the problems as stated above may come to be revealed. Thus, there remains room for further studies.

Studies on improvements of toners have also hitherto attempted. For example, Japanese Patent Applications Laid-open No. H03-84558, No. H03-229268, No. H04-1766 and No. H04-102862 disclose techniques in which the particle shape of toner is made close to being spherical by production processes such as spray granulation, dissolution method, and polymerization. However, these techniques all require large-scale equipment in the production of toners, and not only are unpreferable in view of production efficiency but also have not come to sufficiently improve the developing performance of toners.

Japanese Patent Application Laid-open No. 2003-270856 and No. 2004-188725 also disclose techniques in which toners are thermally modified, which, however, have not still sufficiently well remedied image defects such as sleeve negative ghost.

SUMMARY OF THE INVENTION

An object of the present invention is to provide an image forming method which has resolved the above problems in the background art.

Another object of the present invention is to provide an image forming method which promises superior developing performance even in long-term service, like that in the initial stage.

Still another object of the present invention is to provide an image forming method which promises superior developing performance in any environment.

A further object of the present invention is to provide an image forming method which can keep sleeve negative ghosts from occurring.

A still further object of the present invention is to provide an image forming method which does not form any spots around line images and also promises superior in-page image density uniformity.

A still further object of the present invention is to provide an image forming method which can keep toner melt adhesion to toner regulating blade and toner melt adhesion to toner bearing member from occurring.

A still further object of the present invention is to provide a process cartridge used in the above image forming method.

Stated specifically, the present invention is an image forming method which comprises controlling the layer thickness of a toner on a toner bearing member by means of a toner regulating blade, and developing with the toner on the toner bearing member an electrostatic latent image formed on an electrostatic latent image bearing member;

the toner regulating blade satisfying the following conditions:

i) the toner regulating blade has, at a contact part to be kept in contact with the toner bearing member, a ten-point average roughness Rz in a range of 5.0 μm to 25.0 μm inclusive, as measured with a laser microscope; and ii) the toner regulating blade has, at the contact part, a ratio of the area of contact portions of the contact part to the area of a non-contact portion (=area of contact portions/area of non-contact portion) in a range of 8/92 to 70/30 inclusive, when a glass sheet is brought into contact with that contact part at a face pressure of 22.6 kPa; and the toner satisfying the following conditions:

a) the toner comprises toner base particles containing at least a binder resin and a magnetic material, and fine silica particles;

b) the toner has an average circularity equal to or greater than 0.930 as measured with a flow-type particle image analyzer on particles having a circle-equivalent diameter in a range of 3 μm to 400 μm inclusive; and c) the toner satisfies the following relationship where the aerated bulk density is represented by A (g/cm$^3$) and the amount of the fine silica particles, added to 100 parts by mass of the toner base particles, is represented by x (parts by mass):

$$A>0.085x+0.59.$$

The present invention is also directed to a process cartridge used in an image forming method which comprises controlling the layer thickness of a toner on a toner bearing member by means of a toner regulating blade in the process cartridge, and developing with the toner on the toner bearing member an electrostatic latent image formed on an electrostatic latent image bearing member;

the toner regulating blade satisfying the following conditions:

i) the toner regulating blade has, at a contact part to be kept in contact with the toner bearing member, a ten-point average roughness Rz in a range of 5.0 μm to 25.0 μm inclusive, as measured with a laser microscope; and ii) the toner regulating blade has, at the contact part, a ratio of the area of contact portions to the area of a non-contact portion (=area of contact portions/area of non-contact portion) in a range of 8/92 to 70/30 inclusive, when a glass sheet is brought into contact with that contact part at a face pressure of 22.6 kPa; and the toner held in the process cartridge satisfying the following conditions:

a) the toner comprises toner base particles containing at least a binder resin and a magnetic material, and fine silica particles;

b) the toner has an average circularity of 0.930 or more as measured with a flow-type particle image analyzer on particles having a circle-equivalent diameter in a range of 3 μm or more to 400 μm; and c) the toner satisfies the following relationship where the aerated bulk density is represented by A (g/cm$^3$) and the amount of the fine silica particles, added to 100 parts by mass of the toner base particles, is represented by x (parts by mass):

$$A>0.085x+0.59.$$

DESCRIPTION OF THE PREFERRED EMBODIMENTS

Figure 1:
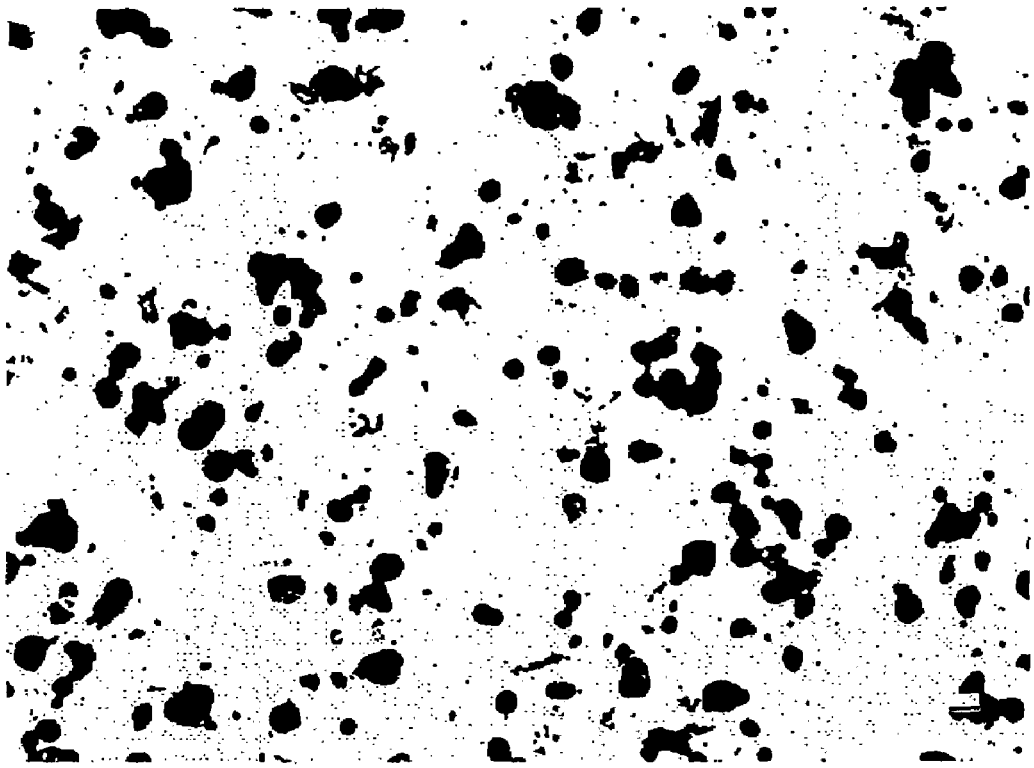
FIG. 1 is an illustration showing contact portions and a non-contact portion between the toner regulating blade and a glass sheet.

As a result of extensive studies, the present inventors have discovered that the controlling of the surface profile of a toner regulating blade which controls the layer thickness of a toner on a toner bearing member and the controlling of the average circularity and aerated bulk density of the toner enable improvement in developing performance of the toner.

The toner regulating blade used in the present invention is characterized by having an uneven surface profile at contact part to be kept in contact with the toner bearing member. The unevenness of the toner regulating blade surface has an influence on the toner layer formed on the toner bearing member. The toner coated on the toner bearing member is controlled with the toner regulating blade, so that the layer thickness of the toner layer on the toner bearing member is controlled. Then, inasmuch as the toner regulating blade has an appropriate surface unevenness, the toner is kept from being fed in excess onto the toner bearing member, and this makes it easy to obtain an appropriate state of toner coating on the toner bearing member.

The toner characterized in the present invention has a certain high average circularity. The toner having such a high average circularity has a superior fluidity, and hence, even where the toner has entered dales of unevenness of the toner regulating blade surface, the toner may readily get away from the dales. On the other hand, where a toner having a low average circularity has entered the dales, the toner may stagnate at the dales because such a toner has not so good fluidity, so that the toner may fill the dales to make it unable to sufficiently obtain the effect to be brought by the toner regulating blade having the surface unevenness as characterized in the present invention. Accordingly, it is important that the toner having a high average circularity is used in combination with the toner regulating blade having a surface unevenness.

Now, the toner used in the present invention participates in development after it has repeatedly so behaved as to enter the dales of unevenness of the toner regulating blade and get away therefrom when it passes the part between the toner regulating blade and the toner bearing member. This means namely that the toner moves greatly at the part where the toner regulating blade and the toner bearing member stand opposite to each other (i.e., the development nip zone). In virtue of such movement, the toner has much opportunity of being triboelectrically charged at the development nip zone, and can acquire higher electric charges, so that it can be improved in developing performance, as so considered.

The toner used in the present invention is also one having an aerated bulk density the value of which is larger than the value of aerated bulk density that is found according to the stated relation. Such a toner has properties of tending to pack relatively densely, and hence the toner can be sent in a larger quantity when the toner is forwarded into the development nip zone. As the result, the toner is improved in its circulation, and hence a toner having an always stable charge quantity can hold onto the toner bearing member. If the toner is insufficiently circulated and when images with much toner consumption (e.g., solid images) are printed, a toner having sufficiently been charged can participate in development for the images at the first rotation of the toner bearing member but the toner may come insufficiently fed at the second and further rotations of the toner bearing member, so that a toner standing not sufficiently charged may participate in the development. In such a case, a difference in image density may be produced between images at the first rotation and those at the second round of the toner bearing member to cause a phenomenon in which the uniformity of image density is damaged (what is called a sleeve negative ghost). Incidentally, the toner having the properties of tending to pack densely tends to have too large thickness for the toner layer to be formed on the toner bearing member, to tend to be insufficiently charged on the toner bearing member. However, in the present invention, the appropriate surface unevenness of the toner regulating blade so acts as to shave off the toner held on the toner bearing member, and hence it keeps the toner layer from having too large thickness on the toner bearing member, so that the toner can be provided with a sufficient charge quantity, as so considered.

The toner regulating blade usable in the present invention has, at the contact part to be kept in contact with the toner bearing member, an area ratio held in the whole contact portions, (area of contact portions)/(area of non-contact portion), ranging from 8/92 to 70/30 inclusive, (preferably ranging from 8/92 to 60/40) inclusive, when a glass sheet is brought into contact with that part at a face pressure of 22.6 kPa. The toner regulating blade also has, at the contact part to be kept in contact with the toner bearing member, a ten-point average roughness Rz in a range of 5.0 μm to 25.0 μm inclusive, preferably in a range of 5.0 μm to 20.0 μm snclusive, and more preferably in a range of 5.0 μm to 15.0 μm inclusive, as measured with a laser microscope. Fulfilling such conditions enables achievement of the effects stated above. If the area ratio (area of contact portions)/(area of non-contact portion) is less than 8/92, the toner layer may come so much controlled as to make the toner level too small on the toner bearing member, and hence part of the toner held thereon may become excessively charged, so that the developing performance may lower because of charge-up especially in a low-temperature and low-humidity environment. If the area ratio is more than 70/30, the toner layer may have such a large thickness as to make the toner insufficiently chargeable, resulting in a lowering of developing performance. Also, if the Rz is less than 5.0 μm, the toner regulating blade may be so strongly pressed against the toner bearing member at the development nip zone as to cause the melt adhesion of toner to the toner bearing member. If the Rz is more than 25.0 μm, the toner regulating blade may be so non-uniformly pressed against the toner bearing member at the development nip zone as to cause non-uniformity of the toner layer, so that the toner may non-uniformly be charged to cause a lowering of the uniformity of images.

The toner usable in the present invention has an average circularity of 0.930 or more, preferably 0.935 or more, and more preferably 0.940 or more, as measured with a flow-type particle image analyzer on particles having a circle-equivalent diameter in a range of 3 μm to 400 μm inclusive. If it has an average circularity of less than 0.930, the toner may, e.g., stagnate at the dales of unevenness of the toner regulating blade surface to make the circulation of the toner insufficient and make the toner insufficiently chargeable, resulting in a lowering of developing performance and to cause sleeve negative ghost.

The toner usable in the present invention is characterized by satisfying the following relationships:

$$A>0.085x+0.59;$$

preferably;

$$A>0.110x+0.61; \text{ and}$$

more preferably;

$$A>0.140x+0.65;$$

where the aerated bulk density is represented by A (g/cm$^3$) and the amount of the fine silica particles, added to 100 parts by mass of the toner base particles, is represented by x (parts by mass). (Here, x is the total amount of fine silica particles added externally to the toner base particles.)

This brings an improvement in the circulation of the toner as stated above and prevents the sleeve negative ghost from occurring. If the toner has an aerated bulk density not satisfying the above relationship, the images may be formed in an insufficient uniformity and the sleeve negative ghost may occur.

The toner may preferably have the aerated bulk density in the range of from 0.60 to 0.90 g/cm$^3$, more preferably from 0.70 to 0.90 g/cm$^3$.

The toner regulating blade usable in the present invention may have an average unevenness hill-to-hill interval Sm in a range of 5.0 μm to 200.0 μm inclusive, and preferably in a range of 5.0 μm to 100.0 μm inclusive, as measured with a laser microscope on the blade surface at the contact part to be kept in contact with the toner bearing member. This enables the toner to be appropriately circulated at the dales and enables the toner to be provided with high and uniform charge characteristics, to bring an improvement in the reproducibility of line images. If the toner regulating blade has an Sm of less than 5.0 μm, the toner may insufficiently come into the dales. If on the other hand it has an Sm of more than 200.0 μm, the toner may easily slip away from the dales to make the toner have so insufficient charge quantity in any cases as to make the reproducibility of line images insufficient and cause spots around line images seriously.

The toner regulating blade used in the present invention is used as a blade member, which is joined to a support member therefor. As materials for the blade, usable are, but not particularly limited to, e.g., urethane resin, polyamide resin, polyamide elastomer, silicone rubber and silicone resin. Urethane rubber may preferably be used from the viewpoint of advantages that an appropriate pressure is applicable to the toner at the development nip zone and that an appropriate circulation performance can be brought to the toner. An additive(s) such as a conducting material may also be added to the above chief material. The support member of the toner regulating blade may preferably be made of a metal flat sheet or a resin flat sheet, and more specifically a stainless steel sheet, a phosphor bronze sheet, an aluminum sheet or the like. The support member and the blade member (toner regulating blade) may, e.g., be bonded to each other with an adhesive.

In the case when a rubber material is used as the material for the toner regulating blade, it may preferably be one having a rubber hardness in a range of 40 degrees to 100 degrees inclusive as JIS-A hardness in order to control the contact portions area ratio described above. It may more preferably have a rubber hardness ranging from 45 degrees to 95 degrees, and still more preferably ranging from 50 degrees to 90 degrees. If it has a rubber hardness of less than 40 degrees, the touch pressure against the toner bearing member tends to be insufficient, and the nip zone between the toner bearing member and the toner regulating blade tends to be broader than is necessary, and may cause a lowering of the charge quantity of the toner. If on the other hand it has a rubber hardness of more than 100 degrees, the touch pressure may be so high that the blade may undesirably cause deterioration of the toner.

As a method by which the toner regulating blade is surface-roughened in the present invention, it may include the following methods. As a physical means, it may include sand blasting, shot blasting and a method making use of sand paper. As a chemical means, it may include etching and a method in which a film containing coarse particles is formed.

Figure 2:
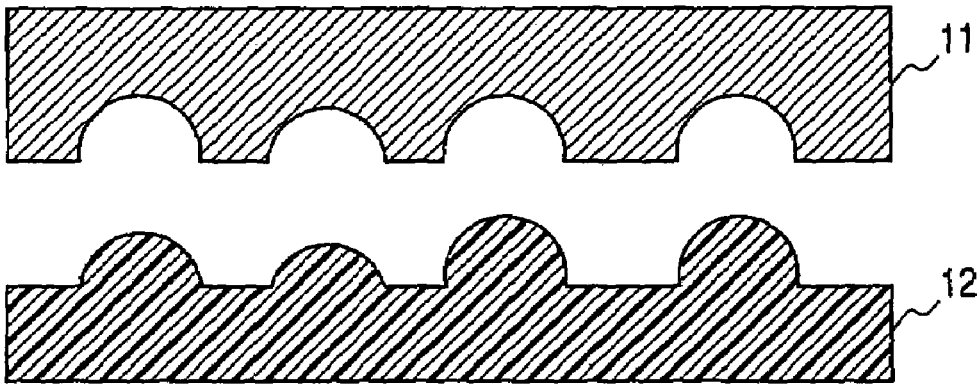
FIG. 2 illustrates how the toner regulating blade is subjected to surface roughening treatment.
Figure 3:
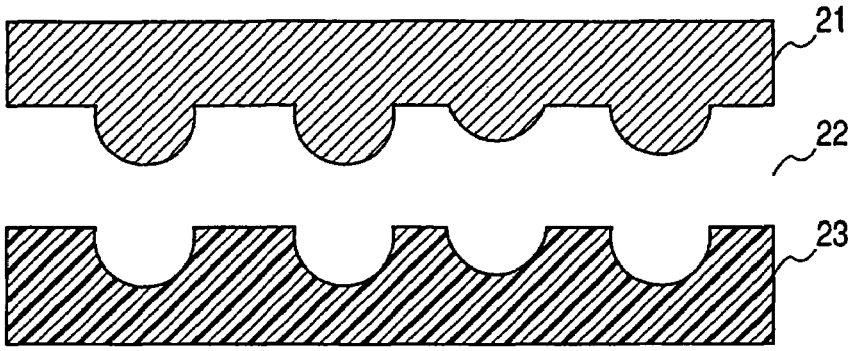
FIG. 3 illustrates how the toner regulating blade is subjected to surface roughening treatment.

In particular, it is preferable in the present invention to carry out molding by using a drum-shaped mold as in centrifugal molding or continuous injection molding. A toner regulating blade forming solution is injected into the mold and, while the mold is rotated, the material is molded into a toner regulating blade cylindrical product. In such a method, centrifugal force is exerted, where the air and the like in the toner regulating blade forming solution get away inwardly and the toner regulating blade forming solution is pressed against the inner peripheral surface of the mold. Hence, a toner regulating blade can be obtained to which the unevenness of the mold inner peripheral surface has accurately been transferred without inclusion of air and the like. Here, as methods by which the unevenness of the mold inner peripheral surface is formed, preferred are a beads blasting method making use of surface roughening particles, and a method in which a release layer is provided on the mold inner peripheral surface and the release layer is incorporated at its surface portion with a surface roughening material such as spherical graphite fluoride particles. These methods enable control of the height of hills (or depth of dales) of unevenness and the unevenness hill-to-hill interval by controlling the particle diameter and content of the surface roughening particles or the surface roughening material. For example, as shown in FIG. 2 as a model representation, in a sheet 12 to which the unevenness has been transferred from a mold 11 the inner peripheral surface of which has been subjected to beads blasting making use of surface roughening particles, hills are gently roundish to have the shape of arcs in section, and the proportion (ratio) of dales and hills and the depth of dales (or height of hills) can be controlled by adjusting the particle diameter of particles and the pressure of blasting. Meanwhile, as shown in FIG. 3 as a model representation, in a sheet 23 to which the unevenness has been transferred from a mold 21 on the inner peripheral surface of which a release layer 22 containing the surface roughening material has been formed, a product is obtainable which has a surface profile where hills are relatively flat and dales are relatively deep.

In the present invention, the ten-point average roughness Rz and average unevenness hill-to-hill interval Sm of the toner regulating blade at its part to be kept in touch with the toner bearing member, and the ratio of the area of contact portions to the area of the non-contact portion of the toner regulating blade when a glass sheet is brought into contact with the toner regulating blade at its part to be kept in touch with the toner bearing member and at a face pressure of 22.6 kPa are measured by a non-contact measuring method making use of a laser microscope (VK-8500, manufactured by Keyence Corporation).

Specific examples of the non-contact measuring method in the present invention are shown below.

How to Measure Ten-point Average Roughness Rz and Average Unevenness Hill-to-Hill Interval Sm 1) To Ready a Sample:

The toner regulating blade is cut in a size of about 1 cm square. However, the size of the cut is not particularly limited as long as the area is sufficient for applying laser light in making an observation with a laser microscope.

2) Measurement Conditions:

In making a measurement, respective parameters and so forth are set as shown below.

Objective lens magnification: 20 magnifications.

Optical zoom magnification: 1 magnification.

Digital zoom magnification: 1 magnification.

Run mode: Color ultradepth.

Laser (gain): 594.

Laser (offset): −1,328.

Camera setting (shutter): 158

Camera setting (white balance): 3,200 k.

Camera setting (gain): 0.

3) Setting of the Sample:

On a stage of the laser microscope, the toner regulating blade thus cut is so set that the part to be kept in contact with the toner bearing member makes the observation surface.

4) Measurement:

The measurement pitch is set at 0.1 μm. The toner regulating blade surface is measured.

5) Image Processing:

Images obtained by the measurement are processed in the following way in order to correct their distortion or inclination.

1. Correction of Inclination

How to correct: Figuring (automatic).

What is to be corrected: Height.

Images obtained by the measurement are processed in the following way in order to remove fine noise components present therein.

2. Filter Processing

Object of processing: To make smooth (height data).

Size: 7×7.

Number of time of execution: 1.

File type: Median.

3. Filter Processing

Object of processing: To make smooth (height data).

Size: 3×3.

Number of time of execution: 1.

File type: Simple average.

6) Analysis:

The height data are used in analysis. The height data images are scaled, and height data in the range of 200 μm×260 μm are picked at three spots at random. In these ranges, the ten-point average roughness Rz and the average unevenness hill-to-hill interval Sm are measured, and their average values are given as measurement results.

Ten-point Average Roughness Rz

The value obtained in a surface roughness measuring mode is given.

Average Unevenness Hill-to-hill Interval Sm

In a linear roughness measuring mode, five straight lines are drawn in arbitrary horizontal directions and five straight lines are drawn in arbitrary vertical directions. Among ten average unevenness hill-to-hill intervals Sm obtained from ten straight lines in total, two marks of upper and lower limit values are excluded, and the value found by averaging the remaining eight marks is given.

How to Measure the Ratio of the Area of Contact Portions to the Area of a Non-contact Portion of the Toner Regulating Blade When a Glass Sheet is Brought Into Contact with the Toner Regulating Blade at the Part to Be Kept in Touch with the Toner Bearing Member and at a Face Pressure of 22.6 kPa As a method of simulating a state in which the toner regulating blade is kept in touch with the toner bearing member in a developing assembly used when the toner in the present invention is evaluated, the toner regulating blade is cut, and a load corresponding to actual touch pressure is applied to the sample piece obtained, to make an observation. This method is shown below. Incidentally, the face pressure 22.6 kPa is the pressure that is close to the pressure at which the toner regulating blade is kept in contact with the toner bearing member, and is the pressure that can be regarded as a model presenting the state of contact between a toner regulating blade and a toner bearing member in a developing assembly.

1) To prepare a sample:

Preparation of Observation Sample

A glass sheet is put on the cut toner regulating blade, in the state that the latter's part to be kept in contact with the toner bearing member is up. Here, the glass sheet is so put on the toner regulating blade that their centers of gravity are in agreement. Weights having the same weight are further put on both (right and left) sides of the glass sheet. The respective weights are so positioned as to be right and left symmetrical with respect to a center of gravity of the toner regulating blade and that of the glass sheet, and also as not to obstruct the approach of an objective lens when the toner regulating blade is observed.

Toner Regulating Blade

The toner regulating blade is precisely cut in a size of 0.8 cm square.

Glass Sheet

The glass sheet may preferably be one having a flat surface. In particular, slide glass (0.9 to 1.2 mm in thickness and 76×26 mm in size; bluish edge-polished glass, available from Matsunami Glass Ind., Ltd.) is preferably used in this measurement.

Weights for Load

In this measurement, the glass sheet is brought into contact with the control blade at the contact part to be kept in contact with the toner bearing member and at a face pressure of 22.6 kPa. A load of 147 g is necessary in order that the glass sheet is brought into contact with the 0.8 cm square control blade at the face pressure of 22.6 kPa. Weights are so readied that the total weight of the two weights having the same weight may come to 147 g. Any desired weights may be used. In this measurement, a method is preferred in which powder with a large specific gravity or water is put into a sample bottle to prepare weights having the desired weight. As the powder with a large specific gravity, it is preferable to use iron powder. As the sample bottle, it is preferable to use a screw thread vial (SV-30; mm in outer diameter, 65 mm in height, 1.5 mm in wall thickness, 19.8 mm in mouth inner diameter, and 30 ml in volume; available from Nichiden-Rika Glass Co., Ltd.)

2) Measurement Conditions:

In performing the measurement, respective parameters and so forth are set as shown below.

Objective lens magnification: 20 magnifications.

Optical zoom magnification: 1 magnification.

Digital zoom magnification: 1 magnification.

Run mode: Color ultradepth.

Laser (gain): 594.

Laser (offset): −1,328.

Camera setting (shutter): 158

Camera setting (white balance): 3,200 k.

Camera setting (gain): 0.

3) Setting of Sample:

On a stage of the laser microscope, the 0.8 cm square control blade to which the load is kept applied is so set that the contact part to be kept in contact with the toner bearing member makes the observation surface.

4) Measurement:

The measurement pitch is set at 0.1 μm.

Measurement is so made as to embrace the contact face between the control blade surface and the glass sheet.

5) Image Processing:

Images obtained by the measurement are processed in the following way in order to correct their distortion or inclination.

1. Correction of Inclination

How to correct: Figuring (automatic)

What is to be corrected: Height.

Images obtained by the measurement are processed in the following way in order to remove fine noise components present therein.

2. Filter Processing

Object of processing: To make smooth (height data)

Size: 7×7.

Number of time of execution: 1.

File type: Median.

3. Filter Processing

Object of processing: To make smooth (height data).

Size: 3×3.

Number of time of execution: 1.

File type: Simple average.

6) Analysis:

The height data are used in analysis. In the height data images obtained, the contact portions between the control blade and the glass sheet are displayed in black in contrast to the non-contact portion (see FIG. 1). The area of the contact portions and that of the non-contact portion are binary-coded by differences in color. This enables calculation of the ratio of the area of the contact portions to the area of the non-contact portion of the control blade when the glass sheet is brought into contact with the toner regulating blade at the contact part to be kept in touch with the toner bearing member and at a face pressure of 22.6 kPa. As a method by which the area of the contact portions and that of the non-contact portion are binary-coded, an application may preferably be used which has the function of image analysis. As the application, IMAGE-PRO PLUS (available from Media Cybernetics, Inc.) may be used, for example.

In binary-coding the area of the contact portions and that of the non-contact portion, the following are operated in order to remove fine noise components of the images obtained, to give values in a higher precision.

A histogram showing data ranging from 0 to 255 as a result of color extraction processing is converted into those ranging from 0 to 60 to thereby remove very fine noise components. This operation enables the contact portions and the non-contact portion to be separated into two colors.

The whole-surface contact portion product of the contact portions is calculated in the measurement of area on measurement items.

The area ratio of the contact portions to the non-contact portion is calculated from the area of the whole images and the total area of the contact portions.

In a solution prepared by dispersing 150 mg of toner base particles in 5 ml of an aqueous surface-active agent solution and further adding 5 ml of 6 mol/l hydrochloric acid to effect extraction for 30 minutes, the solution may preferably have an absorbance in a range of 0.1 to 1.0 inclusive, more preferably in a range of 0.1 to 0.9 inclusive, and still more preferably in a range of 0.1 to 0.8 inclusive, in absorption at 340 nm. The absorption at 340 nm is the absorption chiefly due to the elution of iron. The fact that the absorbance at this 340 nm is in a range of 0.1 to 1.0 inclusive means that iron, i.e., a magnetic material is present on the toner base particle surfaces in a very small quantity, and this enables the toner to be provided with a proper chargeability. If the absorbance is less than 0.1, it follows that the magnetic material is hardly present on the toner base particle surfaces, so that, where the toner regulating blade characteristic of the present invention is used, the toner may be so highly charged as to cause a decrease in image density because it may come charged up especially in a low-temperature and low-humidity environment. If the absorbance is more than 1.0, it follows that the magnetic material is present at the toner base particle surfaces in a large quantity, so that, electric charges of the toner may tend to leak to cause a decrease in image density especially in a high-temperature and high-humidity environment.

As stated above, it is preferable in the present invention that the magnetic material is appropriately present at the toner base particle surfaces. As a result, this can bring a good developing performance to the toner.

In the present invention, the absorbance at 340 nm is determined in the following way.

A dispersant is readied which has been prepared by adding 1.23 mass % of a surface-active agent (preferably sodium dodecylbenzenesulfonate) to water held in a container and from which impurities have been removed. Then, 150 mg of toner base particles are put into a sample bottle, and 5 ml of the dispersant is added, followed by thorough dispersion of the sample (toner base particles). Subsequently, 5 ml of 6 mol/l hydrochloric acid is added, followed by standing for 30 minutes to effect extraction.

The solution having been subjected to the extraction is passed through a sample treating filter (pore size: 0.45 to 0.50 μm; e.g., MAISHORIDISK H-25-5, available from Tosoh Corporation, and EKIKURODISK 25CR, available from German Science Japan, Ltd., may be used), and the filtrate is used as an absorbance measuring sample.

The absorbance is measured with a spectrophotometer (e.g., UV-3100PC of Shimadzu Corporation). Here, a mixed solution of 5 ml of the above dispersant and 5 ml of the above 6 mol/l hydrochloric acid is beforehand put into a control cell.

Measurement conditions: Scan speed: medium speed;

slit width: 0.5 nm; sampling pitch: 2 nm; and measurement range: 600 to 250 nm.

The toner base particles may preferably have, where a polyester resin is used as the binder resin and a hydrocarbon type wax is used as a wax component, a carbon atom peak intensity ratio of 88.5% or more, preferably 90.5% or more, and more preferably 92.0% or more, an oxygen atom peak intensity ratio of 11.5% or less, preferably 9.5% or less, and more preferably 8.0% or less, and an iron atom peak intensity ratio of 1.0% or less, in regard to peaks of carbon atoms, oxygen atoms and iron atoms as measured by ESCA (electron spectroscopy for chemical analysis).

By the ESCA, the levels of elements at the outermost surfaces of toner base particles can quantitatively be determined, and the state of presence of all raw-materials for toner at the outermost surfaces of toner base particles can be specified from the levels of elements thus measured. More specifically, the carbon atoms measured by the ESCA correspond to peaks chiefly due to the wax component and the binder resin component contained in the toner base particles, the oxygen atoms measured by the ESCA correspond to peaks chiefly due to the binder resin component contained in the toner base particles, and the iron atoms measured by the ESCA correspond to peaks chiefly due to the magnetic material component contained in the toner base particles. Thus, in the present invention the measuring of the levels of presence of the carbon atoms, oxygen atoms and iron atoms at the toner base particle surfaces is considered to be synonymous with the measuring of the wax component, binder resin component and magnetic material component present at the toner base particle surfaces.

By virtue of the fact that the toner base particles have the carbon atom peak intensity ratio of 88.5% or more and the oxygen atom peak intensity ratio of 11.5% or less, it follows that the binder resin and the wax are both present in proper proportions at the toner base particle surfaces. This enables the toner to be provided with a good lubricity. The wax present at the toner base particle surfaces provide the toner with appropriate lubricating properties. In the toner regulating blade, the toner comes into contact with the blade surface more frequently at its dales of unevenness, and the toner may melt-adhere to the toner regulating blade. However, the presence of carbon atoms in a proper proportion at the toner base particle surfaces provides an appropriate lubricity to the part between the toner and the toner regulating blade, and this enables appropriate prevention of the melt adhesion of toner to the toner regulating blade, as so considered. If the toner base particles have a carbon atom peak intensity ratio of less than 88.5%, an oxygen atom peak intensity ratio of more than 11.5% or an iron atom peak intensity ratio of more than 1.0%, the toner may have a low lubricity to cause the melt adhesion of toner to the toner regulating blade.

In the present invention, the measurement by ESCA is made using, e.g., QUANTUM 2000 (manufactured by ULVAC-PHI Inc.). As the measurement principle, photoelectrons are generated by utilizing an X-ray source to measure the energy that is based on specific chemical bonds of a substance. As the X-ray, Al-Kα made monochromatic is used, and the measurement is made under conditions of a beam diameter of 50 μm and a pass energy of 46.95 eV.

As a preferred toner base particle production method by which toner base particles having the specific surface properties as described above are obtainable, it is feasible to carry out surface treatment on toner base particles produced by a pulverization process. Details are given later.

In the present invention, the average circularity of the toner is measured in the following way.

Measurement of Average Circularity of Toner

The average circularity of the toner is measured with a flow type particle image analyzer "FPIA-2100 Model" (manufactured by Sysmex Corporation), and is calculated using the following expressions.

Circularity=(Circumferential length of a circle with the same area as particle projected area)/(Circumferential length of particle projected image).

Here, the "particle projected area" is meant to be the area of a binary-coded toner particle image, and the "circumferential length of particle projected image" is defined to be the length of a contour line formed by connecting edge points of the toner particle image. In the measurement, used is the circumferential length of a particle image in image processing at an image processing resolution of 512×512 (a pixel of 0.3 μm×0.3 μm).

The circularity is an index showing the degree of surface unevenness of toner particles. It is indicated as 1.000 when the toner particles are perfectly spherical. The more complex the surface shape is, the smaller the value of circularity.

Average circularity C which means an average value of circularity frequency distribution is calculated from the following expression where the circularity of each particle (the central value at a division point of each class) is represented by ci, and the number of particles measured by m.

Average circularity $$C = \sum_{i=1}^{m} ci/m.$$

The measuring instrument FPIA-2100 used in the present invention calculates the circularity of each particle and thereafter calculates the average circularity, where, according to circularities obtained, particles are apportioned to classes in which circularities ranging from 0.4 to 1.00 are equally divided at intervals of 0.01, and the average circularity is calculated using the apportioned-point center values and the number of particles measured.

As a specific way of measurement, 10 ml of ion-exchanged water from which solid matter impurities or the like has been removed is readied in a container, and a surface active agent (preferably sodium dodecylbenzenesulfonate) is added thereto as a dispersing agent. Thereafter, 0.02 g of a sample for measurement is uniformly dispersed. As a means for dispersing it, an ultrasonic dispersion mixer "TETORAL 50 Model" (manufactured by Nikkaki Bios Co.) is used, and dispersion treatment is carried out for 2 minutes to prepare a fluid dispersion for measurement. In that course, the fluid dispersion is appropriately cooled so that its temperature does not come to 40° C. or more. Also, in order to keep the circularity from scattering, the flow-type particle image analyzer FPIA-2100 is installed in an environment controlled to 23° C. plus-minus 0.5° C. so that its in-machine temperature can be kept at 26 to 27° C., and autofocus control is performed using 2 μm latex particles at intervals of constant time, and preferably at intervals of 2 hours.

In measuring the circularity of the toner, the above flow-type particle image analyzer is used and the concentration in the fluid dispersion is again so controlled that the toner concentration at the time of measurement is 3,000 to 10,000 particles/μl, where 1,000 or more particles are measured. After the measurement, using the data obtained, the average circularity of toner particles in a range of 3 μm to 400 μm or less inclusive in circle-equivalent diameter is determined.

The toner usable in the present invention may preferably satisfy the following relationships:

$$B>0.13x+0.82;$$

preferably;

$$B>0.18x+0.83; \text{ and}$$

more preferably;

$$B>0.22x+0.84;$$

where the packed bulk density is represented by B (g/cm$^3$) and the amount of the fine silica particles, added to 100 parts by mass of the toner base particles, is represented by x (parts by mass). (Here, x is the total amount of fine silica particles added externally to the toner base particles.)

In this case, in virtue of the feature that the toner is more densely present in the state the pressure is applied thereto at the development nip zone, the area of contact between toner particles themselves can be so large that the charge quantity distribution of the toner can consequently be made uniform to effectively prevent fog from being caused by any scattering of charge quantity.

The toner usable in the present invention may preferably satisfy the following relationships:

$$C<1.3x+28;$$

preferably;

$$C<2.1x+26; \text{ and}$$

more preferably;

$$C<2.9x+25;$$

where the compressibility is represented by C (%) and the amount of the fine silica particles, added to 100 parts by mass of the toner base particles, is represented by x (parts by mass). (Here, x is the total amount of fine silica particles added externally to the toner base particles.)

In this case, by virtue of the feature that the compressibility, i.e., the difference between the aerated bulk density and the packed bulk density of the toner is relatively small, the difference in physical properties between the toner to which the pressure stands applied at the development nip zone and the toner having not been forwarded into the development nip zone can be small, so that stable charge characteristics can be obtained. If the compressibility is outside the above range, the toner may cause a decrease in image density during long-term service.

The aerated bulk density (loose bulk density), the packed bulk density (tapped bulk density) and the compressibility (degree of compaction) are measured in the following way, using POWDER TESTER (manufactured by Hosokawa Micron Corporation).

To measure the aerated bulk density (g/cm$^3$) of the toner, the toner is uniformly sifted down from above for 30 seconds through a sieve of 608 μm in mesh opening (24 meshes) into a cylindrical container of 5.03 cm in diameter, 5.03 cm in height and 100 cm$^3$ in volume. Then, the toner is leveled at the top of the cylindrical container, and the toner in the container is weighed.

To measure the packed bulk density (g/cm$^3$) of the toner, after the aerated bulk density of the toner has been measured, a cylindrical cap is fitted to the cylindrical container, and the powder is filled therein up to the top edge of the container, which is then tapped 180 times at a tapping height of 1.8 cm. After the tapping is finished, the cap is taken off. Then, the toner is leveled at the top of the container, and the toner in the container is weighed.

The compressibility C is calculated according to the following expression:

$$C=((B-A)/B)\times 100$$

wherein A is the aerated bulk density of the toner, and B is the packed bulk density of the toner.

In order to make the toner satisfy the above relations in regard to its aerated bulk density or packed bulk density and the content of the fine silica particles, for example the amount of inorganic fine particles to be externally added and the conditions for external addition (such as stirring speed and time) may be controlled in the step of adding the inorganic fine particles externally to the toner base particles, whereby the toner having the desired aerated bulk density and packed bulk density can be obtained.

As types of the binder resin to be contained in the toner base particles of the toner of the present invention, the binder resin may include styrene resins, styrene copolymer resins, polyester resins, polyol resins, polyvinyl chloride resins, phenolic resins, natural resin modified phenolic resins, natural resin modified maleic acid resins, acrylic resins, methacrylic resins, polyvinyl acetate resins, silicone resins, polyurethane resins, polyamide resins, furan resins, epoxy resins, xylene resins, polyvinyl butyral resins, terpene resins, cumarone indene resins, and petroleum resins.

In particular, it is preferable to use polyester resins. An acid component and an alcohol component which are used to form polyester may include the following components.

As a dihydric alcohol component, it may include ethylene glycol, propylene glycol, 1,3-butanediol, 1,4-butanediol, 2,3-butanediol, diethylene glycol, triethylene glycol, 1,5-pentanediol, 1,6-hexanediol, neopentyl glycol, 2-ethyl-1,3-hexanediol, hydrogenated bisphenol A, a bisphenol derivative represented by the following Formula (A) and derivatives thereof:

(A)

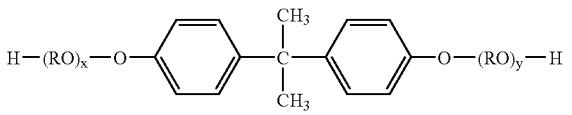

wherein R represents an ethylene group or a propylene group, x and y are each an integer of 0 or more, and a total value of x+y is 0 to 10;

and a diol represented by the following Formula (B):

(B)

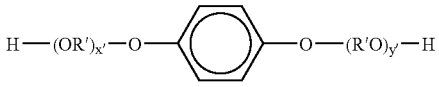

wherein R' represents —$CH_2CH_2$—, —$CH_2CH(CH_3)$—, or —$CH_2C(CH_3)_2$—;

x' and y' are each independently an integer of 0 or more, and the total value of x'+y' is 0 to 10.

As a dibasic acid, it may include dicarboxylic acids and derivatives thereof, as exemplified by benzenedicarboxylic acids such as phthalic acid, terephthalic acid and isophthalic acid, or anhydrides or lower alkyl esters thereof; alkyldicarboxylic acids such as succinic acid, adipic acid, sebacic acid and azelaic acid, or anhydrides or lower alkyl esters thereof; alkenylsuccinic acids or alkylsuccinic acids, such as n-dodecenylsuccinic acid and n-dodecylsuccinic acid, or anhydrides or lower alkyl esters thereof; unsaturated dicarboxylic acids such as fumaric acid, maleic acid, citraconic acid and itaconic acid, or anhydrides or lower alkyl esters thereof.

A trihydric or higher alcohol component and a tribasic or higher acid component serving also as a cross-linking component may preferably be used alone or in combination of two or more types.

The trihydric or higher, polyhydric alcohol component may include, e.g., sorbitol, 1,2,3,6-hexanetetrol, 1,4-sorbitan, pentaerythritol, dipentaerythritol, tripentaerythritol, 1,2,4-butanetriol, 1,2,5-pentanetriol, glycerol, 2-methylpropanetriol, 2-methyl-1,2,4-butanetriol, trimethylolethane, trimethylolpropane and 1,3,5-trihydroxybenzene.

As other dihydric alcohols, they may include, e.g., (1) alkylene glycols having 2 to 12 carbon atoms, such as ethylene glycol, 1,2-propylene glycol, 1,3-propylene glycol, 1,4-butanediol, neopentyl glycol, 1,4-butenediol, 1,5-pentanediol and 1,6-hexanediol; (2) alkylene ether glycols such as diethylene glycol, triethylene glycol, dipropylene glycol, polyethylene glycol, polypropylene glycol and polytetramethylene glycol; (3) alicyclic diols having 6 to 30 carbon atoms, such as 1,4-cyclohexanedimethanol and hydrogenated bisphenol A; and (4) bisphenols such as bisphenol A, bisphenol F and bisphenol S; as well as (5) alkylene oxide (such as ethylene oxide, propylene oxide or butylene oxide) 2- to 8-mol addition products of the above bisphenols.

As specific examples of other trihydric or higher alcohols, they may include, e.g., (1) aliphatic polyhydric alcohols having 3 to 20 carbon atoms, such as sorbitol, 1,2,3,6-hexanetetrol, 1,4-sorbitan, pentaerythritol, dipentaerythritol, tripentaerythritol, 1,2,4-butanetriol, 1,2,5-pentanetriol, glycerol, 2-methylpropanetriol, 2-methyl-1,2,4-butanetriol, trimethylolethane and trimethylolpropane; (2) aromatic polyhydric alcohols having 6 to 20 carbon atoms, such as 1,3,5-trihydroxymethylbenzene; and (3) alkylene oxide addition products of these.

The tribasic or higher, polycarboxylic acid component may include, e.g., pyromellitic acid, 1,2,4-benzenetricarboxylic acid, 1,2,5-benzenetricarboxylic acid, 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, tetra (methylenecarboxyl) methane, 1,2,7,8-octanetetracarboxylic acid, Empol trimer acid, and anhydrides or lower alkyl esters of these; and a tetracarboxylic acid represented by the following formula:

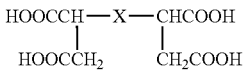

(wherein X represents an alkylene group or alkenylene group having 5 to 30 carbon atoms which has at least one side chain having 3 or more carbon atoms), and anhydrides or lower alkyl esters thereof.

In particular, preferred are 1,2,4-benzenetricarboxylic acid, 1,2,5-benzenetricarboxylic acid and anhydrides or lower alkyl esters of these.

The alcohol component may be in a proportion of from 40 to 60 mol %, and preferably from 45 to 55 mol %; and the acid component, from 60 to 40 mol %, and preferably from 55 to 45 mol %. The trihydric or -basic or higher component may preferably be in a proportion of from 5 to 60 mol % of the whole components.

The polyester resin is usually obtained by commonly known condensation polymerization. The polymerization reaction of the polyester resin is usually carried out in the presence of a catalyst and under a temperature condition of approximately from 150 to 300° C., and preferably from 170 to 280° C. The reaction may also be carried out under normal pressure, under reduced pressure or under some pressure.

As the catalyst, it may include catalysts used usually in polyesterification, as exemplified by metals such as titanium, antimony, manganese, nickel, zinc, lead, iron, magnesium, calcium and germanium; and compounds containing any of these metals, such as dibutyltin oxide, orthodibutyl titanate, tetrabutyl titanate, zinc acetate, lead acetate, cobalt acetate, sodium acetate and antimony trioxide.

Comonomers copolymerizable with styrene monomers in the styrene copolymers may include styrene derivatives such as vinyl toluene; acrylic acid, and acrylates such as methyl acrylate, ethyl acrylate, butyl acrylate, dodecyl acrylate, octyl acrylate, 2-ethylhexyl acrylate and phenyl acrylate; methacrylic acid, and methacrylates such as methyl methacrylate, ethyl methacrylate, butyl methacrylate and octyl methacrylate; dicarboxylic acids having a double bond and esters thereof, such as maleic acid, butyl maleate, methyl maleate and dimethyl maleate; acrylamide, acrylonitrile, methacrylonitrile, and butadiene; vinyl esters such as vinyl chloride, vinyl acetate and vinyl benzoate; ethylenic olefins such as ethylene, propylene and butylene; vinyl ketones such as methyl vinyl ketone and hexyl vinyl ketone; and vinyl ethers such as methyl vinyl ether, ethyl vinyl ether and isobutyl vinyl ether. Any of these vinyl monomers may be used alone or in combination of two or more types.

The binder resin may have a glass transition temperature (Tg) ranging from 45 to 80° C., and preferably ranging from 50 to 70° C., from the viewpoint of storage stability. If it has a Tg of less than 45° C., the toner tends to deteriorate in a high-temperature environment and tends to cause offset at the time of fixing. If on the other hand it has a Tg of more than 80° C., the toner tends to have a low fixing performance.

The Tg is measured according to ASTM D3418, using a differential scanning calorimeter Q-1000, manufactured by TA Instruments Japan Ltd. As the DSC curve used in the present invention, a DSC curve is used which is obtained by measurement when the temperature is raised and dropped once to take pre-history and thereafter raised at a heating rate of 10° C./min. The temperature is defined in the following way.

Glass Transition Point (Tg):

The temperature at the point at which the line that connects middle points (i.e., middle line) between the base lines before and after the appearance of changes in specific heat in the DSC curve at the time of heating intersects the DSC curve.

In the present invention, the molecular weight distribution of the binder resin by GPC (gel permeation chromatography) of its tetrahydrofuran(THF)—soluble matter is measured under the following conditions.

Columns are stabilized in a heat chamber of 40° C. To the columns kept at this temperature, tetrahydrofuran (THF) as a solvent is flowed at a flow rate of 1 ml per minute, and about 100 μl of a sample THF solution is injected thereinto to make measurement. In measuring the molecular weight of the sample, the molecular weight distribution the sample has is calculated from the relationship between the logarithmic value of a calibration curve prepared using several kinds of monodisperse polystyrene standard samples and the number of count. As the standard polystyrene samples used for the preparation of the calibration curve, it is suitable to use samples with molecular weights of approximately from 100 to 10,000,000, which are available from, e.g., Tosoh Corporation or Showa Denko K. K., and to use at least about 10 standard polystyrene samples. An RI (refractive index) detector is used as a detector. Columns should be used in combination of a plurality of commercially available polystyrene gel columns. For example, they may preferably include a combination of Shodex GPC KF-801, KF-802, KF-803, KF-804, KF-805, KF-806, KF-807 and KF-800P, available from Showa Denko K. K.; and a combination of TSKgel G1000H($H_{XL}$), G2000H($H_{XL}$), G3000H($H_{XL}$), G4000H ($H_{XL}$), $G_{5000}$H($H_{XL}$), G6000H($H_{XL}$), G7000H($H_{XL}$) and TSK guard column, available from Tosoh Corporation.

The sample is prepared in the following way.

The sample is put in THF, and is left standing for several hours, followed by thorough shaking so as to be well mixed with the THF (until coalescent matter of the sample has disappeared), which is further left standing for at least 12 hours. Here, the sample is so left standing as to stand in THF for at least 24 hours. Thereafter, the solution having been passed through a sample treating filter (pore size: 0.45 to 0.5 μm; e.g., MAISHORIDISK H-25-5, available from Tosoh Corporation, or EKIKURODISK 25CR, available from German Science Japan, Ltd., may be used) is used as the sample for GPC. The sample is so adjusted as to have resin components in a concentration ranging from 0.5 to 5.0 mg/ml.

The toner base particles of the toner in the present invention may be incorporated with a wax. The wax used in the present invention may include the following. For example, paraffin wax and derivatives thereof, montan wax and derivatives thereof, microcrystalline wax and derivatives thereof, Fischer-Tropsch wax and derivatives thereof, polyolefin wax and derivatives thereof, and carnauba wax and derivatives thereof. The derivatives may include oxides, block copolymers with vinyl monomers, and graft modified products.

The wax may have a melting point ranging from 50 to 130° C., preferably ranging from 60 to 125° C., and more preferably from 65 to 120° C. This is preferable from the viewpoint of endowing the toner with good fixing performance, anti-offset properties and storage stability. If the wax has a melting point of less than 50° C., the toner may have low anti-blocking properties. If it has a melting point of more than 130° C., the wax may adversely affect the fixing performance of the toner.

In the present invention, the melting point of the wax may be measured with a differential thermal analysis measuring instrument (DSC measuring instrument) DSC-7 (manufactured by Perkin-Elmer Corporation) under the following conditions.

Measured according to ASTM D3418.

Sample: 0.5 to 2 mg, preferably 1 mg.

Measuring method: The sample is put in an aluminum pan, and an empty aluminum pan is used as reference. Temperature curve:

Heating I (20° C. to 180° C.; heating rate: 10° C./min).

Cooling I (180° C. to 10° C.; cooling rate: 10° C./min).

Heating II (10° C. to 180° C.; heating rate: 10° C./min).

In the above temperature curve, the endothermic peak temperature measured at Heating II is regarded as the melting point.

As preferable amount of the wax added to the toner base particles, the wax may be used in an amount ranging from 0.2 to 20 parts by mass, preferably from 0.5 to 15 parts by mass, and more preferably from 1 to 15 parts by mass, based on 100 parts by mass of the binder resin.

The toner of the present invention may preferably be incorporated with a charge control agent.

A charge control agent capable of controlling the toner to be negatively chargeable may include the following compounds.

For example, organic metal complex salts and chelate compounds are effective, including monoazo metal complexes, acetylyacetone metal complexes, aromatic hydroxycarboxylic acid and aromatic dicarboxylic acid type metal complexes. Besides, they also include aromatic hydroxycarboxylic acids, aromatic mono- and polycarboxylic acids, and metal salts, anhydrides or esters thereof, and phenol derivatives such as bisphenol.

In particular, azo-type metal complexes represented by the following general formula (1) are preferred.

(1)

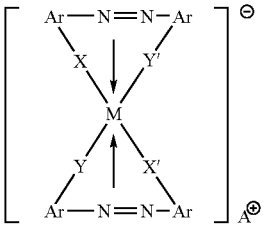

In the formula, M represents a central metal of coordination, including Sc, Ti, V, Cr, Co, Ni, Mn or Fe. Ar represents an aryl group, including a phenyl group or a naphthyl group, which may have a substituent. In such a case, the substituent may include a nitro group, a halogen atom, a carboxyl group, an anilide group, and an alkyl group having 1 to 18 carbon atoms or an alkoxyl group having 1 to 18 carbon atoms. X, X', Y and Y' each represent —O—, —CO—, —NH— or —NR— (R is an alkyl group having 1 to 4 carbon atoms). $A^+$ represents a counter ion, and represents a hydrogen ion, a sodium ion, a potassium ion, an ammonium ion or an aliphatic ammonium ion, or a mixed ion of any of these.

In particular, Fe is preferred as the central metal. As the substituent, a halogen atom, an alkyl group or an anilide group is preferred. As the counter ion, a hydrogen ion, an alkali metal ion, an ammonium ion or an aliphatic ammonium ion is preferred. A mixture of complexes having different counter ions may also preferably be used.

Basic organic acid metal complexes represented by the following general formula (2) are also preferable as charge control agents capable of imparting negative chargeability.

(2)

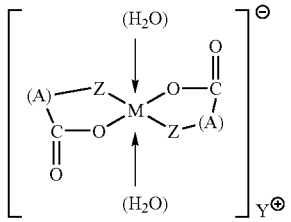

In the formula (2), M represents a central metal of coordination, including Cr, Co, Ni, Mn, Fe, Zn, Al, Si or B. A represents;

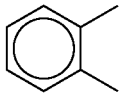

(which may have a substituent such as an alkyl group)

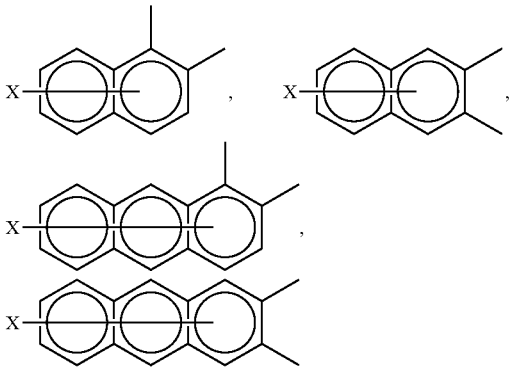

(X represents a hydrogen atom, a halogen atom, a nitro group or an alkyl group), and

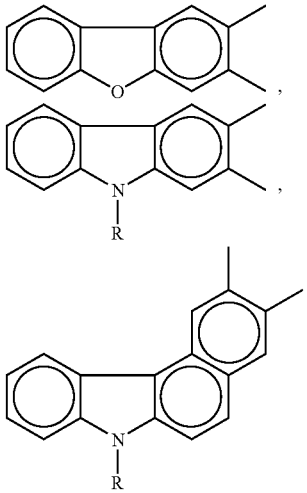

(R represents a hydrogen atom, an alkyl group having 1 to 18 carbon atoms or an alkenyl group having 2 to 16 carbon atoms);

$Y^+$ represents a counter ion, and represents a hydrogen ion, a sodium ion, a potassium ion, an ammonium ion, an aliphatic ammonium ion, or a mixed ion of any of these. Z represents —O— or

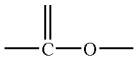

As the central metal, Fe, Cr, Si, Zn or Al is particularly preferred. As the substituent, an alkyl group, an anilide group, an aryl group or a halogen atom is preferred. As the counter ion, a hydrogen ion, an ammonium or an aliphatic ammonium ion is preferred.

A charge control agent capable of controlling the toner to be positively chargeable includes the following compounds.

Nigrosine and products modified with a fatty acid metal salt; quaternary ammonium salts such as tributylbenzylammonium 1-hydroxy-4-naphthosulfonate and tetrabutylammonium teterafluoroborate, and analogues of these, i.e., onium salts such as phosphonium salts, and lake pigments of these, triphenylmethane dyes and lake pigments of these (lake-forming agents include tungstophosphoric acid, molybdophosphoric acid, tungstomolybdophosphoric acid, tannic acid, lauric acid, gallic acid, ferricyanides and ferrocyanides); metal salts of higher fatty acids; diorganotin oxides such as dibutyltin oxide, dioctyltin oxide and dicyclohexyltin oxide; and diorganotin borates such as dibutyltin borate, dioctyltin borate and dicyclohexyltin borate; guanidine compounds, and imidazole compounds. Any of these may be used alone or in combination of two or more types. Of these, triphenylmethane compounds, and quaternary ammonium salts whose counter ions are not halogens may preferably be used.

Homopolymers of monomers represented by the general formula (3):

(3)

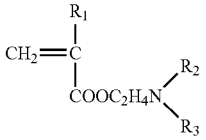

wherein $R_1$ represents a hydrogen atom or a methyl group; $R_2$ and $R_3$ each represent a substituted or unsubstituted alkyl group (preferably having 1 to 4 carbon atoms);

or copolymers with polymerizable monomers such as styrene, acrylates or methacrylates as described above may also be used as positive charge control agents. In this case, these charge control agents also even have the action as binder resins (as a whole or in part).

In particular, compounds represented by the following general formula (4) are preferred as charge control agents in the present invention.

(4)

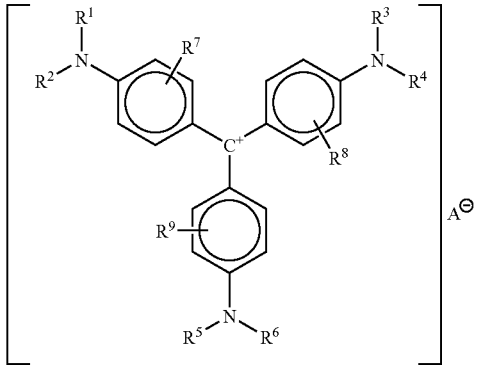

wherein $R^1$ to $R^6$ may be the same or different from one another and each represent a hydrogen atom, a substituted or unsubstituted alkyl group or a substituted or unsubstituted aryl group; $R^7$ to $R^9$ may be the same or different from one another and each represent a hydrogen atom, a halogen atom, an alkyl group or an alkoxyl group; and $A^-$ represents a negative ion selected from a sulfate ion, a nitrate ion, a borate ion, a phosphate ion, a hydroxide ion, an organic sulfate ion, an organic sulfonate ion, an organic phosphate ion, a carboxylate ion, an organic borate ion, and tetrafluoroborate.

As methods for incorporating the toner with the charge control agent, available are a method of adding it internally to toner base particles and a method of adding it externally to toner base particles. The amount of the charge control agent used depends on the type of the binder resin, the presence or absence of any other additives, and the manner by which the toner is produced, including the manner of dispersion, and can not absolutely be specified. Preferably, the charge control agent may be used in an amount ranging from 0.1 to 10 parts by mass, and more preferably ranging from 0.1 to 5 parts by mass, based on 100 parts by mass of the binder resin.

The toner base particles of the present invention contain a magnetic material. The magnetic material may also has the function of a colorant. The magnetic material to be contained in the toner may include iron oxides such as magnetite, hematite and ferrite; metals such as iron, cobalt and nickel, or alloys of any of these metals with a metal such as aluminum, cobalt, copper, lead, magnesium, tin, zinc, antimony, beryllium, bismuth, cadmium, calcium, manganese, selenium, titanium, tungsten or vanadium, and mixtures of any of these.

These magnetic materials may preferably be those having a number-average particle diameter ranging from 0.05 μm to 1.0 μm, and more preferably ranging from 0.1 μm to 0.5 μm. Also, preferably usable are those having a BET specific surface area of from 2 to 40 $m^2/g$ (more preferably ranging from 4 to 20 $m^2/g$). There are no particular limitations on the particle shape, and those having any shape may be used. As magnetic properties, the magnetic material may have an intensity of magnetization ranging from 10 to 200 $Am^2/kg$ (preferably ranging from 70 to 100 $Am^2/kg$), a residual magnetization ranging from 1 to 100 $Am^2/kg$ (preferably ranging from 2 to 20 $Am^2/kg$) and a coercive force ranging from 1 to 30 kA/m (preferably ranging from 2 to 15 kA/m) under application of a magnetic field of 795.8 kA/m, which may preferably be used. Any of these magnetic materials may be used in an amount ranging from 20 to 200 parts by mass, and preferably ranging from 40 to 150 parts by mass, based on 100 parts by mass of the binder resin.

The number-average particle diameter of the magnetic material may be determined by measuring it using a digitizer or the like on the basis of a photograph taken in magnification on a transmission electron microscope or the like. The magnetic properties of the magnetic material may be measured with "Vibration Sample Type Magnetism Meter VSM 3S-15" (manufactured by Toei Industry Co., Ltd.) under application of an external magnetic field of 795.8 kA/m. To measure the specific surface area, according to the BET method and using a specific surface area measuring instrument AUTOSOBE 1 (manufactured by Yuasa Ionics Co.), nitrogen gas is adsorbed on the surface of a sample, and the BET specific surface area is calculated using the BET multi-point method.

Where a colorant is added to the toner, any known suitable pigment or dye may be used. The pigment may include carbon black, Aniline Black, acetylene black, Naphthol Yellow, Hanza Yellow, Rhodamine Lake, Alizarine Lake, red iron oxide, Phthalocyanine Blue and Indanethrene Blue. Any of these may be used in an amount necessary for maintaining optical density of fixed images, and may be added in an amount of from 0.1 to 20 parts by mass, and preferably from 0.2 to 10 parts by mass, based on 100 parts by mass of the binder resin. The dye may include azo dyes, anthraquinone dyes, xanthene dyes and methine dyes. The dye may be added in an amount of from 0.1 to 20 parts by mass, and preferably from 0.3 to 10 parts by mass, based on 100 parts by mass of the binder resin.

In the toner used in the present invention, fine silica particles are externally added to the toner base particles.

Fine silica particles may include both what is called dry-process silica or fumed silica produced by vapor phase oxidation of silicon halides and what is called wet-process silica produced from water glass or the like. The dry-process silica is preferred, as having less silanol groups on the surfaces and insides of the particles and leaving less production residues.

The fine silica particles may further preferably be those having been hydrophobic-treated. For making them hydrophobic, the fine silica particles may be made hydrophobic by chemical treatment with an organosilicon compound capable of reacting with or physically adsorptive on the fine silica particles. As a preferable method, the dry-process silica produced by vapor phase oxidation of a silicon halide may be treated with an organosilicon compound such as silicone oil after it has been treated with a silane compound or at the same time it is treated with a silane compound.

The silane compound used in the hydrophobic treatment may include hexamethyldisilazane, trimethylsilane, trimethylchlorosilane, trimethylethoxysilane, dimethyldichlorosilane, methyltrichlorosilane, allyldimethylchlorosilane, allylphenyldichlorosilane, benzyldimethylchlorosilane, bromomethyldimethylchlorosilane, α-chloroethyltrichlorosilane, β-chloroethyltrichlorosilane, chloromethyldimethylchlorosilane, triorganosilane mercaptan, trimethylsilyl mercaptan, triorganosilyl acrylate, vinyldimethylacetoxysilane, dimethylethoxysilane, dimethyldimethoxysilane, diphenyldiethoxysilane, hexamethyldisiloxane, 1,3-divinyltetramethyldisiloxane, and 1,3-diphenyltetramethyldisiloxane.

The organosilicon compound may include silicone oils. As silicone oils, preferred are those having a viscosity at 25° C. of from 30 to 1,000 $mm^2/s$. For example, preferred are dimethylsilicone oil, methylphenylsilicone oil, α-methylstyrene modified silicone oil, chlorophenylsilicone oil and fluorine modified silicone oil.

As a method for the treatment with silicone oil, a method may be employed in which the fine silica particles treated with a silane compound and the silicone oil are directly mixed by means of a mixing machine such as Henschel mixer, or the silicone oil is sprayed on the fine silica particles serving as a base. Alternatively, the silicone oil may be dissolved or dispersed in a suitable solvent and thereafter the base fine silica particles may be mixed, followed by removal of the solvent to prepare the treated product.

As preferable hydrophobic treatment of the fine silica particles, a method is available in which the fine silica particles are first treated with hexamethyldisilazane and then treated with silicone oil to prepare the treated product.

It is preferable to treat the fine silica particles with a silane compound and thereafter make treatment with silicone oil as described above, because their hydrophobicity can effectively be improved.

The fine silica particles to be mixed with (externally added to) the toner base particles may be used in an amount ranging from 0.01 to 5 parts by mass, preferably ranging from 0.01 to 3 parts by mass, more preferably ranging from 0.01 to 2 parts by mass, and particularly preferably ranging from 0.01 to 1.5 parts by mass.

In the toner, additives other than the fine silica particles may optionally be added to the toner base particles.

Such other fine particles may include lubricants such as polyfluoroethylene powder, zinc stearate powder and polyvinylidene fluoride powder (in particular, polyvinylidene fluoride powder is preferred); abrasives such as cerium oxide powder, silicon carbide powder and strontium titanate powder (in particular, strontium titanate powder is preferred); fluidity-providing agents such as titanium oxide powder and aluminum oxide powder (in particular, hydrophobic one is preferred); anti-caking agents; and conductivity-providing agents such as carbon black, zinc oxide powder, antimony oxide powder and tin oxide powder. White fine particles and black fine particles having polarity opposite to that of the toner may also be used in a small quantity as a developing performance improver.

Fine resin particles may also be used, and those having an average particle diameter ranging of 0.03 μm to 1.0 μm are preferred. A polymerizable monomer constituting the resin of the resin particles may include monomers as exemplified by styrene; styrene derivatives such as o-methylstyrene, m-methylstyrene, p-methylstyrene, p-methoxystyrene and p-ethylstyrene; acrylic acid; methacrylic acid; acrylic esters such as methyl acrylate, ethyl acrylate, n-butyl acrylate, isobutyl acrylate, n-propyl acrylate, n-octyl acrylate, dodecyl acrylate, 2-ethylhexyl acrylate, stearyl acrylate, 2-chloroethyl acrylate and phenyl acrylate; methacrylic esters such as methyl methacrylate, ethyl methacrylate, n-propyl methacrylate, n-butyl methacrylate, isobutyl methacrylate, n-octyl methacrylate, dodecyl methacrylate, 2-ethylhexyl methacrylate, stearyl methacrylate, phenyl methacrylate, dimethylaminoethyl methacrylate and diethylaminoethyl methacrylate; and acrylonitrile, methacrylonitrile and acrylamides.

As a polymerization process, it may include suspension polymerization, emulsion polymerization and soap-free polymerization. More preferably, resin particles obtained by soap-free polymerization are favorable.

Further usable are a charging auxiliary agent, a caking preventive agent, a release agent used in heat roll fixing, and so forth.

The fine resin particles, inorganic fine particles or hydrophobic inorganic fine particles other than the fine silica particles to be blended with the toner base particles may be used in an amount ranging from 0.01 to 5 parts by mass, and preferably ranging from 0.01 to 3 parts by mass, based on 100 parts by mass of the toner base particles.

The toner used in the present invention may preferably have a weight-average particle diameter (D4) ranging from 2.5 μm to 10.0 μm, more preferably ranging from 4.0 μm to 9.0 μm, and particularly preferably ranging from 5.0 μm to 8.0 μm.

The weight-average particle diameter and particle size distribution of the toner are measured by the Coulter Counter method. For example, Coulter Multisizer (manufactured by Coulter Electronics, Inc.) may be used. As an electrolytic solution, an aqueous 1% NaCl solution is prepared using first-grade sodium chloride. For example, ISOTON R-II (available from Coulter Scientific Japan Co.) may be used. As a measuring method, 0.1 to 5 ml of a surface active agent (preferably sodium dodecylbenzenesulfonate) is added as a dispersant to 100 to 150 ml of the above aqueous electrolytic solution, and 2 to 20 mg of a sample for measurement is further added. The electrolytic solution in which the sample has been suspended is subjected to dispersion for about 1 minute to about 3 minutes in an ultrasonic dispersion machine. The volume distribution and number distribution of the toner are determined by measuring the volume and number of toner particles of 2.00 μm or more in diameter by means of the above measuring instrument, using an aperture of 100 μm as its aperture. Then the weight average particle diameter (D4) is calculated. As channels, 13 channels are used, which are of 2.00 to less than 2.52 μm, 2.52 to less than 3.17 μm, 3.17 to less than 4.00 μm, 4.00 to less than 5.04 μm, 5.04 to less than 6.35 μm, 6.35 to less than 8.00 μm, 8.00 to less than 10.08 μm, 10.08 to less than 12.70 μm, 12.70 to less than 16.00 μm, 16.00 to less than 20.20 μm, 20.20 to less than 25.40 μm, 25.40 to less than 32.00 μm, and 32.00 to less than 40.30 μm.

To produce the toner, the toner constituent materials as described above may be well mixed by means of a ball mill or any other mixing machine, followed by sufficient kneading using a heat kneading machine such as a heat roll, a kneader or an extruder. The kneaded product obtained may be cooled to solidify, followed by crushing, and further fine pulverization. The finely pulverized product obtained is classified to obtain a classified powder. Further, the classified powder is subjected to surface modification by means of a surface modifying apparatus. Such a method is preferred. The surface modification may preferably be treatment in which high-temperature hot air is instantaneously blown to the classified powder obtained and immediately thereafter the particles are cooled with cold air to effect surface modification. In the case when the surfaces of toner base particles are modified in this way, any excess heat is by no means applied to the toner base particles, and hence the surface modification of toner base particles can be carried out while preventing raw-material components from changing in properties. Also, since the particles are instantaneously cooled, it by no means comes about that the toner base particles coalesce mutually in excess to come greatly differ in particle diameter from that of toner base particles having not been subjected to the surface modification, and hence the physical properties of toner base particles having been subjected to the surface modification can readily be controlled also in the step of producing the toner. An apparatus which can carry out such surface modification may include, e.g., Meteo Rainbow (manufactured by Nippon Pneumatic Mfg. Co., Ltd.). After the surface modification of toner base particles, additives may further be sufficiently mixed (externally added) by means of a mixing machine such as Henschel mixer to produce the toner.

For example, as the mixing machine, it may include, e.g., Henschel Mixer (manufactured by Mitsui Mining & Smelting Co., Ltd.); Super Mixer (manufactured by Kawata MFG Co., Ltd.); Conical Ribbon Mixer (manufactured by Y. K. Ohkawara Seisakusho); Nauta Mixer, Turbulizer, and Cyclomix (manufactured by Hosokawa Micron Corporation); Spiral Pin Mixer (manufactured by Pacific Machinery & Engineering Co., Ltd.); and Rhedige Mixer (manufactured by Matsubo Corporation). As a kneading machine, it may include KRC Kneader (manufactured by Kurimoto, Ltd.); Buss-Co-Kneader (manufactured by Coperion Buss Ag.); TEM-type Extruder (manufactured by Toshiba Machine Co., Ltd.); TEX Twin-screw Extruder (manufactured by The Japan Steel Works, Ltd.); PCM Kneader (manufactured by Ikegai Corp.); Three-Roll Mill, Mixing Roll Mill, and Kneader (manufactured by Inoue Manufacturing Co., Ltd.); Kneadex (manufactured by Mitsui Mining & Smelting Co., Ltd.); MS-type Pressure Kneader, and Kneader-Ruder (manufactured by Moriyama Manufacturing Co., Ltd.); and Banbury Mixer (manufactured by Kobe Steel, Ltd.). As a grinding machine, it may include Counter Jet Mill, Micron Jet, and Inomizer (manufactured by Hosokawa Micron Corporation); IDS-type Mill, and PJM Jet Grinding Mill (manufactured by Nippon Pneumatic MFG Co., Ltd.); Cross Jet Mill (manufactured by Kurimoto, Ltd.); Ulmax (manufactured by Nisso Engineering Co., Ltd.); SK Jet O-Mill (manufactured by Seishin Enterprise Co., Ltd.); Criptron (manufactured by Kawasaki Heavy Industries, Ltd); Turbo Mill (manufactured by Turbo Kogyo Co., Ltd.); and Super Rotor (manufactured by Nisshin Engineering Inc.). As a classifier, it may include Classyl, Micron Classifier, and Spedic Classifier (manufactured by Seishin Enterprise Co., Ltd.); Turbo Classifier (manufactured by Nisshin Engineering Inc.); Micron Separator, Turboprex(ATP), and TSP Separator (manufactured by Hosokawa Micron Corporation); Elbow Jet (manufactured by Nittetsu Mining Co., Ltd.); Dispersion Separator (manufactured by Nippon Pneumatic MFG Co., Ltd.); and YM Microcut (manufactured by Yasukawa Shoji K. K.). As a sifter used to sieve coarse powder and so forth, it may include Ultrasonics (manufactured by Koei Sangyo Co., Ltd.); Rezona Sieve, and Gyro Sifter (manufactured by Tokuju Corporation); Vibrasonic Sifter (manufactured by Dulton Company Limited); Sonicreen (manufactured by Shinto Kogyo K. K.); Turbo-Screener (manufactured by Turbo Kogyo Co., Ltd.); Microsifter (manufactured by Makino mfg. co., ltd.); and circular vibrating screens.

EXAMPLES

The present invention is described below in greater detail by giving Examples, which, however, by no means limit the present invention.

Toner Regulating Blade Production Process

Toner Regulating Blade

Production Process 1

As a centrifugal molding mold heated to 140° C. was kept rotated at a rate of revolutions of 800 rpm, a thermosetting resin liquid material (epoxy resin; heat-resisting temperature: 150° C.) was casted into the centrifugal molding mold, and was sufficiently made to come heat-cured to provide a retainer layer (an eccentricity compensation layer) of 1.0 mm in thickness. Next, on the inner peripheral surface of the retainer layer, a release layer of silicone rubber was formed in a thickness of 2.0 mm, in the course of which, before the release layer came completely cured, a surface roughening material (graphite fluoride particles; weight average particle diameter: 8.0 μm; standard deviation: 1.53 μm) dispersed in toluene was spread on its inner peripheral surface. Into the mold having the release layer thus formed, a urethane layer forming fluid was casted to carry out centrifugal molding, followed by heating to effect curing. The molded product thus obtained was demolded and then press-cut into a rectangular shape having a desired size to obtain Toner regulating blade 1. Toner regulating blade 1 obtained was one in which the Rz was 10.2 μm, the Sm was 35.1 μm, the area ratio (=area of contact portions/area of non-contact portion) when a glass sheet was brought into contact at a face pressure of 22.6 kPa was 40/60, the rubber hardness was 65 degrees, and the thickness was 1.17 mm. Physical properties of Toner Regulating Blade 1 are shown in Table 1.

Toner Regulating Blade

Production Process 2

Toner regulating blade 2 was obtained in the same manner as in Toner Regulating Blade Production Process 1 except that graphite fluoride particles having an average particle diameter of 15.2 μm and a standard deviation of 5.23 μm were used as the surface roughening material. Physical properties of Toner Regulating Blade 2 are shown in Table 1.

Toner Regulating Blade

Production Process 3

The inner peripheral surface of a centrifugal molding mold was blast-finished by blasting #60 glass bead particles against the surface at an air pressure of 4.5 kg/cm$^2$. Into the centrifugal molding mold thus blast-finished, a urethane layer forming fluid was casted to carry out centrifugal molding, followed by heating to effect curing. The molded product thus obtained was demolded and then press-cut into a rectangular shape having a desired size to obtain Toner Regulating Blade 3. Toner Regulating Blade 3 obtained was one in which the Rz was 24.5 μm, the Sm was 120.3 μm, the area ratio (=area of contact portions/area of non-contact portion) when a glass sheet was brought into contact at a face pressure of 22.6 kPa was 27/73, the rubber hardness was 65 degrees, and the thickness was 1.17 mm. Physical properties of Toner Regulating Blade 3 are shown in Table 1.

Toner Regulating Blade

Production Process 4

Toner Regulating Blade 4 was obtained in the same manner as in Toner Regulating Blade Production Process 1 except that the graphite fluoride particles having an average particle diameter of 15.2 μm and a standard deviation of 5.23 μm were spread and thereafter graphite fluoride particles having an average particle diameter of 4.1 μm and a standard deviation of 1.35 μm were spread. Physical properties of Toner regulating blade 4 are shown in Table 1.

Toner Regulating Blade

Production Process 5

Toner Regulating Blade 5 was obtained in the same manner as in Toner Regulating Blade Production Process 1 except that graphite fluoride particles having an average particle diameter of 4.1 μm and a standard deviation of 1.35 μm were used as the surface roughening material. Physical properties of Toner Regulating Blade 5 are shown in Table 1.

Toner Regulating Blade

Production Process 6

Toner Regulating Blade 6 was obtained in the same manner as in Toner Regulating Blade Production Process 5 except that the surface roughening material was spread in a smaller quantity. Physical properties of Toner Regulating Blade 6 are shown in Table 1.

Toner Regulating Blade

Production Process 7

Toner Regulating Blade 7 was obtained in the same manner as in Toner Regulating Blade Production Process 3 except that the glass bead particles were sprayed in a smaller quantity than that in Control Blade Production Process 3. Physical properties of Toner Regulating Blade 7 are shown in Table 1.

Toner Regulating Blade

Production Process 8

Toner Regulating Blade 8 was obtained in the same manner as in Toner regulating blade Production Process 7 except that #180 glass bead particles were used and sprayed in a smaller quantity than that in Control Blade Production Process 7, and further the molded product obtained was subjected to curing treatment. Physical properties of Toner regulating blade 8 are shown in Table 1.

TABLE 1

Toner Regulating Blade Physical Properties

| Toner regulating blade: | Ten-point average roughness Rz (μm) | Average unevenness hill = to-hill interval (μm) | Area of contact portion/area of non-contact portion | Rubber hardness |
|---|---|---|---|---|
| 1 | 10.2 | 35.1 | 40/60 | 65 |
| 2 | 17.8 | 60.8 | 32/68 | 65 |
| 3 | 24.5 | 120.3 | 27/73 | 65 |
| 4 | 16.4 | 18.0 | 63/37 | 65 |
| 5 | 6.7 | 4.3 | 53/47 | 65 |
| 6 | 4.1 | 70.2 | 72/28 | 65 |
| 7 | 26.9 | 220.5 | 15/85 | 65 |
| 8 | 8.3 | 304.3 | 7/93 | 100 |

Production of

Toner Base Particles 1 (by mass)

Polyester resin 100 parts (Condensation polymerization product of Bisphenol-propyleneoxide adduct, trimellitic anhydride and terephthalic acid, peak molecular weight: 6,100; acid value: 18.5 mgKOH/g)

Magnetic material 95 parts (number average particle diameter: 0.19 μm; BET specific surface area: 9.0 g/m$^2$; Hc: 5.7 kA/m; intensity of magnetization in a magnetic field of 795.8 kA/m: 83.9 μm$^2$/kg; or: 5.3 μm$^2$/kg)

Monoazo iron complex 2 parts (T-77, available from Hodogaya Chemical Co., Ltd.)

Fischer-Tropsch wax 4 parts (SASOL C105 (SASOL Co.), melting point: 105° C.)

The above materials were premixed by means of Henschel mixer, and thereafter the mixture obtained was melt-kneaded by means of a twin-screw kneader heated to 110° C. The kneaded product obtained and having been cooled was crushed by means of a hammer mill to obtain a crushed toner material product. The crushed product obtained was finely pulverized by using a mechanical grinding machine Turbo Mill (manufactured by Turbo Kogyo Co., Ltd.; the surfaces of its rotor and stator were coated by plating of a chromium alloy containing chromium carbide (plating thickness: 150 μm; surface hardness: HV 1,050)). The finely pulverized product thus obtained was classified by means of a multi-division classifier utilizing the Coanda effect (Elbow Jet Classifier, manufactured by Nittetsu Mining Co., Ltd.) to classify and remove fine powder and coarse powder simultaneously. The classified powder obtained there had a weight-average particle diameter (D4) of 6.3 μm.

Next, the classified powder was subjected to surface modification by means of Meteo Rainbow (manufactured by Nippon Pneumatic Mfg. Co., Ltd.), which is an apparatus for carrying out surface modification by spraying hot air, to obtain Toner Base Particles 1. The surface modification was carried out under conditions of a raw-material feed rate of 2 kg/hr, a hot-air flow rate of 700 liters/min and a jetting hot-air temperature of 300° C. Toner Base Particles 1 thus obtained had a weight-average particle diameter (D4) of 6.7 μm. Physical properties of Toner Base Particles 1 are shown in Table 2.

Production of

Toner Base Particles 2 to 7

Toner Base Particles 2 to 7 were obtained in the same manner as Toner Base Particles 1 except that the surface modification conditions were changed as shown in Table 2. Physical properties of Toner Base Particles 2 to 7 are shown in Table 2.

TABLE 2

| Toner base particles: | Conditions for surface modification: Treating particles feed rate (kg/hr) | Blasting hot air temp. (° C.) | Average particle diameter after surface modification (μm) | ESCA measurement results: Carbon atom peak intensity ratio (%) | Oxygen atom peak intensity ratio (%) | Iron atom peak intensity ratio (%) | Absorbance at 340 nm |
|---|---|---|---|---|---|---|---|
| 1 | 2.0 | 300 | 6.7 | 95.6 | 4.4 | *1 | 0.66 |
| 2 | 0.5 | 450 | 6.4 | 97.1 | 2.9 | *1 | 0.08 |
| 3 | 2.0 | 265 | 6.9 | 92.5 | 7.5 | *1 | 0.77 |
| 4 | 2.0 | 220 | 7.1 | 90.7 | 9.3 | *1 | 0.87 |
| 5 | 2.0 | 195 | 7.2 | 88.8 | 9.8 | 1.4 | 1.05 |
| 6 | 3.0 | 280 | 6.7 | 85.8 | 12.2 | 2.0 | 0.97 |
| 7 | (No surface modification.) | | 6.3 | 79.7 | 18.2 | 2.1 | 1.43 |

*1: Below the limit of detection.

Preparation of Toner 1

100 parts by mass of Toner Base Particles 1 and 0.4 part by mass of hydrophobic fine silica particles having been treated with hexamethyldisilazane and then treated with dimethylsilicone oil (number average primary particle diameter: 2 nm; BET specific surface area: 150 $m^2/g$) were mixed for 1 minute at 3,500 rpm, and thereafter, 0.4 part by mass of the above hydrophobic fine silica particles were further added, followed by mixing for 1 minute at 3,000 rpm, both by means of Henschel Mixer 10B (manufactured by Mitsui Miike Engineering Corporation) to prepare negatively chargeable Toner 1. Physical properties of Toner 1 are shown in Table 3.

Preparation of Toner 2

Toner 2 was prepared in the same manner as in Preparation of Toner 1 except that Toner Base Particles 2 were used. Physical properties of Toner 2 are shown in Table 3.

Preparation of Toner 3

100 parts by mass of Toner Base Particles 3 and 0.3 part by mass of the hydrophobic fine silica particles as used in Preparation of Toner 1 were mixed for 1 minute at 3,500 rpm, and thereafter, 0.2 part by mass of the above hydrophobic fine silica particles were further added, followed by mixing for 1 minute at 3,000 rpm, both by means of Henschel Mixer 10B (manufactured by Mitsui Miike Engineering Corporation) to prepare Toner 3. Physical properties of Toner 3 are shown in Table 3.

Preparation of Toner 4

100 parts by mass of Toner Base Particles 4 and 1.35 parts by mass of the hydrophobic fine silica particles as used in Preparation of Toner 1 were mixed by means of Henschel Mixer 10B (manufactured by Mitsui Miike Engineering Corporation) for 2 minutes at 4,000 rpm to prepare Toner 4. Physical properties of Toner 4 are shown in Table 3.

Preparation of Toner 5

Toner 5 was prepared in the same manner as in Preparation of Toner 1 except that Toner Base Particles 5 were used. Physical properties of Toner 5 are shown in Table 3.

Preparation of Toner 6

Toner 6 was prepared in the same manner as in Preparation of Toner 1 except that Toner Base Particles 6 were used. Physical properties of Toner 6 are shown in Table 3.

Preparation of Toner 7

100 parts by mass of Toner Base Particles 7 and 0.7 part by mass of the hydrophobic fine silica particles as used in Preparation of Toner 1 were mixed for 1 minute at 3,500 rpm, and thereafter, 0.65 parts by mass of the above hydrophobic fine silica particles were further added, followed by mixing for 1 minute at 3,000 rpm, both by means of Henschel Mixer 10B (manufactured by Mitsui Miike Engineering Corporation) to prepare Toner 7. Physical properties of Toner 7 are shown in Table 3.

TABLE 3

| Toner: | Toner base particles | Total amount of fine silica particles added externally (pbm) | Aerated bulk density A ($g/cm^3$) | Packed bulk density B ($g/cm^3$) | Compressibility C (%) | Average circularity |
|---|---|---|---|---|---|---|
| 1 | 1 | 0.80 | 0.78 | 1.06 | 26.4 | 0.955 |
| 2 | 2 | 0.80 | 0.85 | 1.14 | 25.4 | 0.973 |
| 3 | 3 | 0.50 | 0.73 | 0.98 | 25.5 | 0.942 |
| 4 | 4 | 1.35 | 0.71 | 1.05 | 32.4 | 0.936 |
| 5 | 5 | 0.80 | 0.75 | 1.01 | 25.7 | 0.931 |
| 6 | 6 | 0.80 | 0.75 | 1.02 | 26.5 | 0.950 |
| 7 | 7 | 1.35 | 0.64 | 0.93 | 31.2 | 0.923 |

pbm: part(s) by mass

Examples 1 to 10 &

Comparative Examples 1 to 4

Next, using the toners prepared, evaluation was made in the manner as described below. The results of evaluation are shown in Table 4.

As an evaluation machine, a laser beam printer LASER JET 4300n, manufactured by Hewlett-Packard Co. was so altered as to drive at a process speed of 60 sheets/minute, and was used after its toner regulating blade was changed for each of the above-described Toner Regulating Blades 1 to 7. The toner regulating blade was, at its rear end portion, bonded with an adhesive to a toner regulating blade support member made of a metal, and thereafter set so that the contact pressure against the toner bearing member is 22.6 kPa in the developing assembly.

In each environment of a normal-temperature and normal-humidity environment (23° C./60% RH), a low-temperature and low-humidity environment (15° C./10% RH) and a high-temperature and high-humidity environment (32.5° C./80% RH), an image reproduction test was conducted on 10,000 sheets of copying plain paper (A4-size; basis weight: 75 g/m$^2$) at a printing speed of 1 sheet/10 seconds and in a print percentage of 5%, and, after the printer was left standing for a day, the image reproduction test was again conducted on 10,000 sheets, i.e., 20,000 sheets in total, while replenishing the toner.

(1) Image Density, Fog:

The image density was measured with MACBETH REFLECTION DENSITOMETER (manufactured by Macbeth Co.), as relative density of solid black image areas with respect to images printed on a white background area having a copy paper density of 0.00.

The fog was calculated from comparison between the whiteness of a transfer sheet and the whiteness of the transfer sheet after print of solid white images, both of which were measured with a reflectometer manufactured by Tokyo Denshoku Co., Ltd.

Figure 4:
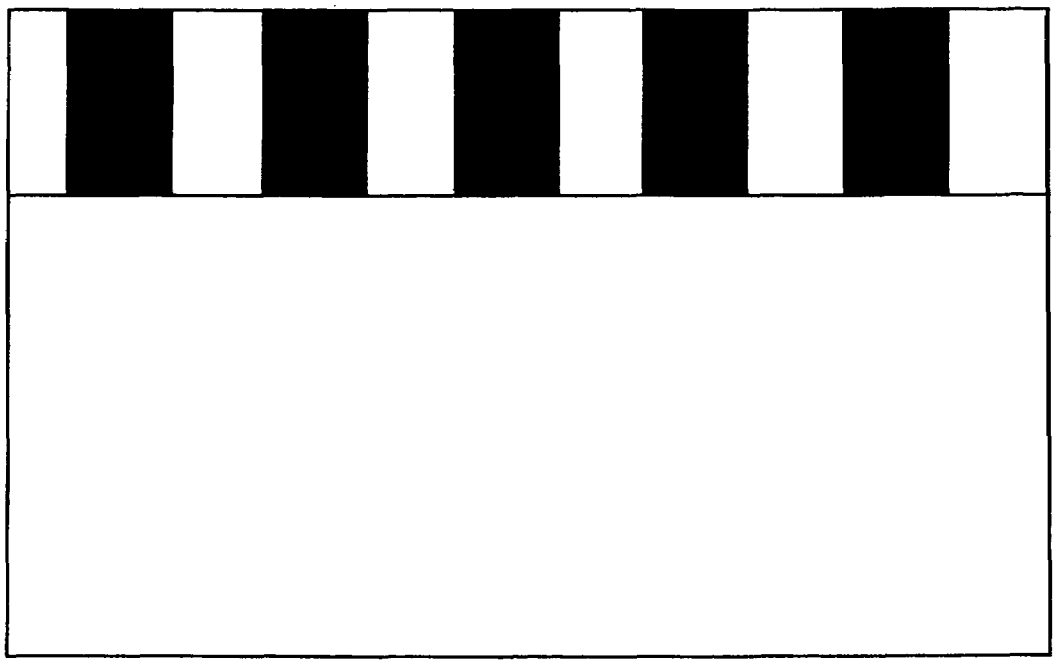
FIG. 4 illustrates a pattern for making evaluation on a sleeve negative ghost.

(2) Sleeve negative ghost:

For image evaluation in regard to ghosts, solid black stripes were reproduced for only one round of the sleeve in the low-temperature and low-humidity environment and thereafter a halftone image was reproduced. Its pattern is schematically shown in FIG. 4. As an evaluation method, on one sheet of printed images, the difference in reflection density measured with the Macbeth reflection densitometer on the second round of the sleeve, between a place where the solid black images were formed (black print areas 1) on the first round and a place where they were not formed (non-image areas 2) was calculated as shown below. The sleeve negative ghost is a ghost phenomenon in which, usually on images coming on the second round of the sleeve, the image density at the part having stood black print areas on the first round of the sleeve is lower than the image density at the part having stood non-image areas on the first round of the sleeve, and the shape of the pattern reproduced on the first round appears as it is. As to the difference in density here, the difference in reflection density was measured to make evaluation.

Reflection density difference=(reflection density at a place where no image is formed)−(reflection density at a place where images are formed).

The smaller the difference in reflection density is, the less the ghost appears, showing a better level. As overall evaluation of the ghost, evaluation was made according to four ranks of A, B, C and D. The worst evaluation results in the evaluation for each 10,000-sheet running test are shown in Table 4.

A: Reflection density difference is less than 0.02.

B: Reflection density difference is 0.02 or more to less than 0.04.

C: Reflection density difference is 0.04 or more to less than 0.06.

D: Reflection density difference is 0.06 or more.

(3) Spots Around Line Images:

In the image evaluation in the normal-temperature and normal-humidity environment, a lattice pattern with 100 μm (latent image) lines (at intervals of 1 cm) was printed at the initial stage and on the 4,000th sheet, and spots around line images formed were visually observed on an optical microscope to make evaluation.

A: Lines are very sharp and spots around line images are little seen.

B: On the level of being slightly spotted, and lines are relatively sharp.

C: Spots around line images a little much appear more, and lines look vague.

D: Not reach the level of C.

(4) In-page image density uniformity:

In images printed in the normal-temperature and normal-humidity environment, in-page uniformity was judged by the difference between the maximum value and the minimum value, of solid black image density. As overall evaluation of the in-page uniformity, evaluation was made according to four ranks of A, B, C and D. The worst evaluation results in the evaluation for each 10,000-sheet running test are shown in Table 4.

A: Solid black image density difference is 0.00 or more to less than 0.05.

B: Solid black image density difference is 0.05 or more to less than 0.10.

C: Solid black image density difference is 0.10 or more to less than 0.15.

D: Solid black image density difference is 0.15 or more.

(5) Toner Melt Adhesion to Toner Regulating Blade:

In images printed in the high-temperature and high-humidity environment, evaluation was visually made on image lines caused by the melt adhesion of toner to the toner regulating blade.

A: Less than 1 image line appears per 10 cm width.

B: 1 or more to less than 3 image lines appear(s) per 10 cm width.

C: 3 or more to 5 or less image lines appear per 10 cm width.

D: 5 or more image lines appear per 10 cm width.

(6) Toner Melt Adhesion to Toner Bearing Member:

The surface of the toner bearing member after the running in the high-temperature and high-humidity environment was visually observed to make evaluation on the extent of contamination with toner according to the following criteria.

A: Slight contamination is seen.

B: Contamination is somewhat seen.

C: Contamination is partly seen.

D: Serious contamination is seen.

TABLE 4

| | Toner | | N/N After 20,000 sheets | | | L/L | | | | | H/H | | | |
|---|---|---|---|---|---|---|---|---|---|---|---|---|---|---|
| | | | | Spots | Image density | Initial stage | | After 20,000 sheets | | Sleeve | Initial stage | After 20,000 sheets | | |
| | regulating blade | Toner No. | Image density | around line images | uniformity | Image density | Fog | Image density | Fog | negative ghost | Image density | Image density | (1) | (2) |
| Example: | | | | | | | | | | | | | | |
| 1 | 1 | 1. | 1.39 | A | A | 1.44 | 1.2 | 1.43 | 1.3 | A | 1.40 | 1.38 | A | A |
| 2 | 1 | 2 | 1.37 | A | A | 1.43 | 1.4 | 1.34 | 2.3 | A | 1.38 | 1.36 | A | A |
| 3 | 1 | 3 | 1.36 | A | A | 1.41 | 1.5 | 1.40 | 1.7 | A | 1.37 | 1.35 | A | A |
| 4 | 1 | 4 | 1.33 | A | A | 1.37 | 2.3 | 1.30 | 2.7 | C | 1.31 | 1.27 | B | A |
| 5 | 1 | 5 | 1.31 | A | A | 1.35 | 1.8 | 1.32 | 2.0 | B | 1.29 | 1.26 | C | A |
| 6 | 1 | 6 | 1.35 | A | A | 1.39 | 1.7 | 1.37 | 1.8 | A | 1.35 | 1.34 | C | A |
| 7 | 2 | 1 | 1.38 | A | B | 1.42 | 1.3 | 1.41 | 1.4 | A | 1.39 | 1.37 | A | A |
| 8 | 3 | 1 | 1.37 | B | C | 1.40 | 1.5 | 1.38 | 1.6 | A | 1.37 | 1.36 | A | A |
| 9 | 4 | 1 | 1.32 | A | B | 1.34 | 2.2 | 1.30 | 2.6 | A | 1.34 | 1.30 | A | A |
| 10 | 5 | 1 | 1.35 | C | A | 1.39 | 1.7 | 1.37 | 1.8 | B | 1.35 | 1.33 | A | B |
| Comparative Example: | | | | | | | | | | | | | | |
| 1 | 6 | 4 | 0.98 | B | B | 1.01 | 4.9 | 0.86 | 5.5 | D | 0.97 | 0.79 | C | D |
| 2 | 7 | 4 | 1.08 | D | D | 1.12 | 3.8 | 1.02 | 4.2 | D | 1.04 | 0.92 | C | B |
| 3 | 8 | 4 | 1.06 | D | B | 1.10 | 4.1 | 0.89 | 4.5 | D | 1.03 | 0.87 | C | C |
| 4 | 6 | 7 | 0.95 | B | B | 0.97 | 5.2 | 0.71 | 5.9 | D | 0.81 | 0.51 | D | D |

N/N: Normal-temperature and normal-humidity environment
L/L: Low-temperature and low-humidity environment
H/H: high-temperature and high-humidity environment
(1): Toner melt adhesion to toner regulating blade
(2): Toner melt adhesion to toner bearing member This application claims priority from Japanese Patent Application No. 2005-266743 filed on Sep. 14, 2005, which is hereby incorporated by reference herein.

What is claimed is:

1. An image forming method comprising the steps of:

controlling the layer thickness of a toner on a toner bearing member by means of a toner regulating blade; and developing with the toner on the toner bearing member an electrostatic latent image formed on an electrostatic latent image bearing member;

the toner regulating blade satisfying the following conditions:

i) the toner regulating blade has, at a contact part to be kept in contact with the toner bearing member, a ten-point average roughness Rz in a range of 5.0 μm to 25.0 μm inclusive, as measured with a laser microscope; and ii) the toner regulating blade has, at the contact part, a ratio of the area of contact portions of the contact part to the area of a non-contact portion (=area of contact portions/area of non-contact portion) in a range of 8/92 to 70/30 inclusive, when a glass sheet is brought into contact with the contact part at a face pressure of 22.6 kPa; and the toner satisfying the following conditions:

a) the toner comprises toner base particles containing at least a binder resin and a magnetic material, and fine silica particles;

b) the toner has an average circularity equal to or greater than 0.930 as measured with a flow-type particle image analyzer on particles having a circle-equivalent diameter in a range of 3 μm to 400 μm inclusive; and c) the toner satisfies the following relationship where the aerated bulk density is represented by A (g/cm$^3$) and the amount of the fine silica particles, added to 100 parts by mass of the toner base particles, is represented by x (parts by mass):

$$A>0.085x+0.59.$$

2. The image forming method according to claim 1, wherein, in a solution prepared by dispersing 150 mg of toner base particles in 5 ml of an aqueous surface-active agent solution and adding 5 ml of 6 mol/l hydrochloric acid to effect extraction for 30 minutes, the solution has an absorbance in a range of 0.1 or more to 1.0 inclusive, in absorption at 340 nm.

3. The image forming method according to claim 1, wherein, in regard to peaks of carbon atoms, oxygen atoms and iron atoms as measured by electron spectroscopy for chemical analysis, the toner base particles have a carbon atom peak intensity ratio of 88.5% or more, an oxygen atom peak intensity ratio of 11.5% or less and an iron atom peak intensity ratio of 1.0% or less.

4. The image forming method according to claim 1, wherein the toner satisfies the following relationship:

$$B>0.13x+0.82,$$

where the packed bulk density thereof is represented by B (g/cm$^3$) and the amount of the fine silica particles, added to 100 parts by mass of the toner base particles, is represented by x (parts by mass).

5. The image forming method according to claim 1, wherein said toner satisfies the following relationship:

$$C<1.3x+28,$$

where the compressibility thereof is represented by C (%) and the amount of the fine silica particles, added to 100 parts by mass of the toner base particles, is represented by x (parts by mass).

6. The image forming method according to claim 1, wherein said toner regulating blade has, at the contact part to be kept in contact with said toner bearing member, an average unevenness hill-to-hill interval Sm in a range of 5.0 μm to 200.0 μm inclusive, as measured with a laser microscope.

7. A process cartridge used in an image forming method comprising the steps of controlling the layer thickness of a toner on a toner bearing member by means of a toner regulating blade in said process cartridge, and developing with the toner on the toner bearing member an electrostatic latent image formed on an electrostatic latent image bearing member;

said toner regulating blade satisfying the following conditions:

i) said toner regulating blade has, at a contact part to be kept in contact with said toner bearing member, a ten-point average roughness Rz in a range of 5.0 μm to 25.0 μm inclusive, as measured with a laser microscope; and ii) said toner regulating blade has, at said contact part, a ratio of the area of contact portions of the contact part to the area of a non-contact portion (=area of contact portions/area of non-contact portion) of 8/92 to 70/30 inclusive, when a glass sheet is brought into contact with said contact part at a face pressure of 22.6 kPa; and said toner in said process cartridge satisfying the following conditions:

a) said toner comprises toner base particles containing at least a binder resin and a magnetic material, and fine silica particles;

b) said toner has an average circularity of 0.930 or more as measured with a flow-type particle image analyzer on particles having a circle-equivalent diameter in a range of 3 μm to 400 μm inclusive; and c) said toner satisfies the following relationship where the aerated bulk density is represented by A ($g/cm^3$) and the amount of said fine silica particles, added to 100 parts by mass of said toner base particles, is represented by x (parts by mass):

$$A>0.085x+0.59.$$

* * * * *